US007380603B2

(12) United States Patent
Jeffrey et al.

(10) Patent No.: US 7,380,603 B2
(45) Date of Patent: Jun. 3, 2008

(54) WELL ABANDONMENT APPARATUS

(75) Inventors: Steven Jeffrey, Glasgow (GB); Harold Ashton, Aberdeenshire (GB); Ian Stuart Gray-Taylor, Aberdeenshire (GB)

(73) Assignee: Well-Worx Limited, Chichester, West Sussex (GB)

( * ) Notice: Subject to any disclaimer, the term of this patent is extended or adjusted under 35 U.S.C. 154(b) by 224 days.

(21) Appl. No.: 10/524,282

(22) PCT Filed: Aug. 14, 2003

(86) PCT No.: PCT/GB03/03542

§ 371 (c)(1),
(2), (4) Date: Feb. 10, 2005

(87) PCT Pub. No.: WO2004/016901

PCT Pub. Date: Feb. 26, 2004

(65) Prior Publication Data

US 2005/0263282 A1 Dec. 1, 2005

(30) Foreign Application Priority Data

Aug. 14, 2002 (GB) ..... 0218836.5

(51) Int. Cl.
*E21B 33/00* (2006.01)

(52) U.S. Cl. ..... 166/285; 166/298; 166/377

(58) Field of Classification Search ..... 166/285, 166/298, 377, 55.7, 55.8
See application file for complete search history.

(56) References Cited

U.S. PATENT DOCUMENTS

| | | | | |
|---|---|---|---|---|
| 5,101,895 | A | 4/1992 | Gilbert | |
| 5,261,486 | A * | 11/1993 | Cornette et al. | 166/51 |
| 5,381,631 | A | 1/1995 | Raghavan et al. | |
| 5,957,198 | A | 9/1999 | Haynes | |
| 6,012,526 | A | 1/2000 | Jackson et al. | |
| 6,155,343 | A | 12/2000 | Lynde et al. | |
| 6,431,626 | B1 * | 8/2002 | Bouligny | 291/86.25 |
| 6,478,088 | B1 * | 11/2002 | Hansen et al. | 166/285 |
| 6,629,565 | B2 * | 10/2003 | Harrell | 166/361 |

* cited by examiner

*Primary Examiner*—William P Neuder
(74) *Attorney, Agent, or Firm*—Drinker, Biddle & Reath LLP

(57) ABSTRACT

A well abandonment apparatus is described. The apparatus can be run on drillstring and does not require the use of explosives to sever the casing. The apparatus includes both a cutting device to perforate and sever the casing and a sealing device to prevent well fluids from reaching the surface while the well abandonment operation is proceeding.

11 Claims, 23 Drawing Sheets

WELL ABANDONMENT APPARATUS

This Application is the U.S. National Phase Application of PCT International Application No PCT/GB2003/003542 filed Aug. 14, 2003.

This invention relates to apparatus and a method for treating wells, especially but not exclusively for abandoning hydrocarbon-bearing wells.

DESCRIPTION OF THE RELATED ART

When wells have reached the end of their useful life, they need to be abandoned. The top of the casing strings must be cut off near the wellhead, whilst ensuring that no further hydrocarbons can leak through the casing strings and into the surrounding area. The bottom of the annulus between the two innermost casings is in communication with the formation. Therefore, if this annulus is not completely sealed, hydrocarbons from the formation could leak out. Usually, wells are abandoned using explosives to sever the casings. These are harmful for fish and the environment. Furthermore, underwater explosions are difficult to control and there is a risk of damaging the well plug, causing it to leak.

BRIEF SUMMARY OF THE INVENTION

According to the present invention there is provided well treatment apparatus comprising a cutting tool; a sealing device to seal a portion of a wellbore; and an anchor means to anchor the apparatus with respect to the wellbore.

Preferably, the sealing device comprises at least one and preferably two annular cup devices typically orientated in the same direction to provide a double seal between the portion of the well beneath the sealing device and the surface of the well.

Optionally, the sealing device comprises two annular cup devices orientated in opposite directions (e.g. with cups facing one another) to seal the portion of the apparatus in between the two oppositely-orientated devices from the rest of the bore.

Preferably, a first fluid circulation device is positioned between the two oppositely orientated cup devices.

Typically the cup devices can be cup-type seal assemblies, typically with axially extending conduits for e.g. control lines and fluid lines. A preferred cup device can be constructed from a packer (e.g. such as a gas line packer available from Double-E, Inc), modified so that its rubber part allows the packer to perform a sealing function, and including bulkhead connections providing axial passages through the packer.

Preferably, the apparatus adapted to attach to a drillstring and the sealing device is typically adapted to, in use, seal the annulus between the drillstring and the innermost casing of the wellbore.

Typically, the cup device has a cup-shaped body (typically at least a portion of this is made from a deformable material, such as high density rubber). Preferably, a part of the cup device is adapted to deform outwards to seal the annulus upon the application of pressure from inside the cup-shaped body. In use, fluid flowing into the cup-shaped body typically deforms the cup-shaped body so that the external face of the cup presses against the inner face of the casing, preventing or restricting fluid from flowing past the cup device.

Typically, a further fluid-circulating device is located between the sealing device and the cutting tool. Typically, fluid can be diverted between the circulating devices by dropping a ball/dart into the body of the apparatus.

Optionally, at least one further seal is located beneath the cutting tool, to seal the portion of the bore around the cutting tool from that below the cutting tool. Preferably, the at least one further seal is a cup-type seal assembly.

Preferably, the cutting tool comprises a jet cut nozzle that is able to cut through casings that line the bore. Preferably, the nozzle is movable e.g. rotatable in two perpendicular planes (e.g. horizontal and vertical) so that the nozzle can cut circular apertures in the casing. Preferably the nozzle/cutting tool is also rotatable through 360° to enable the cutting tool to cut around the entire circumference of the casing.

Optionally, the anchor means is located on the body of the cutting tool. Alternatively, the anchor means could be provided on a further sub separate from the cutting tool.

Preferably, at least one part of the anchor means is laterally extendable. The laterally extendable part of the anchor means typically has a foot for engaging a wall of a casing.

Preferably, the foot has a high-friction casing-contacting surface. Typically, the casing-contacting surface extends around the entire circumference of the anchor means.

A typical anchor means can be provided by modifying a packer device having an expandable anchor portion; the modification typically includes the removal of the interior packing material to leave a hollow bore through the packer. Such packer devices typically have an exterior anchor portion, which is expanded on moving a first part of the anchor device relative to a second part.

Optionally, the cutting tool has at least two (e.g. three or more) circumferentially spaced feet, to engage the interior of the casing at circumferentially spaced locations. The or each foot can be mounted on a moveable arm that can be driven by a ram or alternatively at least one of the feet can be static e.g. provided on the body of the cutting tool, or on an extension of the body.

According to a second aspect of the invention, there is provided a method of treating a well, including the steps of:

- inserting well treatment apparatus into a cased wellbore, the apparatus including a cutting tool, a sealing device and an anchor means;
- perforating the innermost casing in two vertically spaced positions; and
- injecting cement into a portion of the annulus between the two innermost casing strings to seal the annulus;
- whereby the method includes the step of using the anchor means to anchor the apparatus to the cased wellbore.

Typically, the method includes the step of pressure testing the innermost casing before the first perforation is made by injecting a fluid into the wellbore below the sealing means.

Typically, the method includes the step of pressure testing the annulus before the second perforation is made by injecting a fluid into the wellbore below the sealing means and measuring the equilibrium rate of pumping as the fluid flows through the first perforation into the annulus.

Optionally, the method includes the step of pressure testing the annulus after the second perforation has been made by injecting a fluid into the annulus to check that there are no blockages in the part of that annulus lying between the vertically spaced perforations.

Typically, the sealing device includes two oppositely orientated cup devices, and the cement is injected into the annulus from an aperture in the apparatus located between these two cup devices.

Optionally, the method includes the step of pressure testing the sealed annulus by positioning the apparatus so that the sealing device lies between the two vertically spaced perforations and by injecting fluid into the wellbore below the sealing device.

Preferably, the method includes the step of using the cutting tool to sever the casings above the perforations after the annulus has been sealed, and typically tested for seal integrity.

Typically, the method including the step of undertaking at least one pressure test by injecting fluids, whereby during the pressure test, the apparatus is anchored to the casing by the anchor means to counter the upwards force on the apparatus by the injected fluids.

Typically, the well treatment apparatus is mounted on a drillstring and is manoeuvred in the wellbore by raising and lowering the drillstring.

Typically the fluid used in the pressure tests is water, but in some circumstances cement or other fluids can be used.

BRIEF DESCRIPTION OF THE SEVERAL VIEWS OF THE DRAWINGS

An embodiment of the invention will now be described by way of example only and with reference to the following drawings, in which.

DETAILED DESCRIPTION OF THE INVENTION

Figure 1:
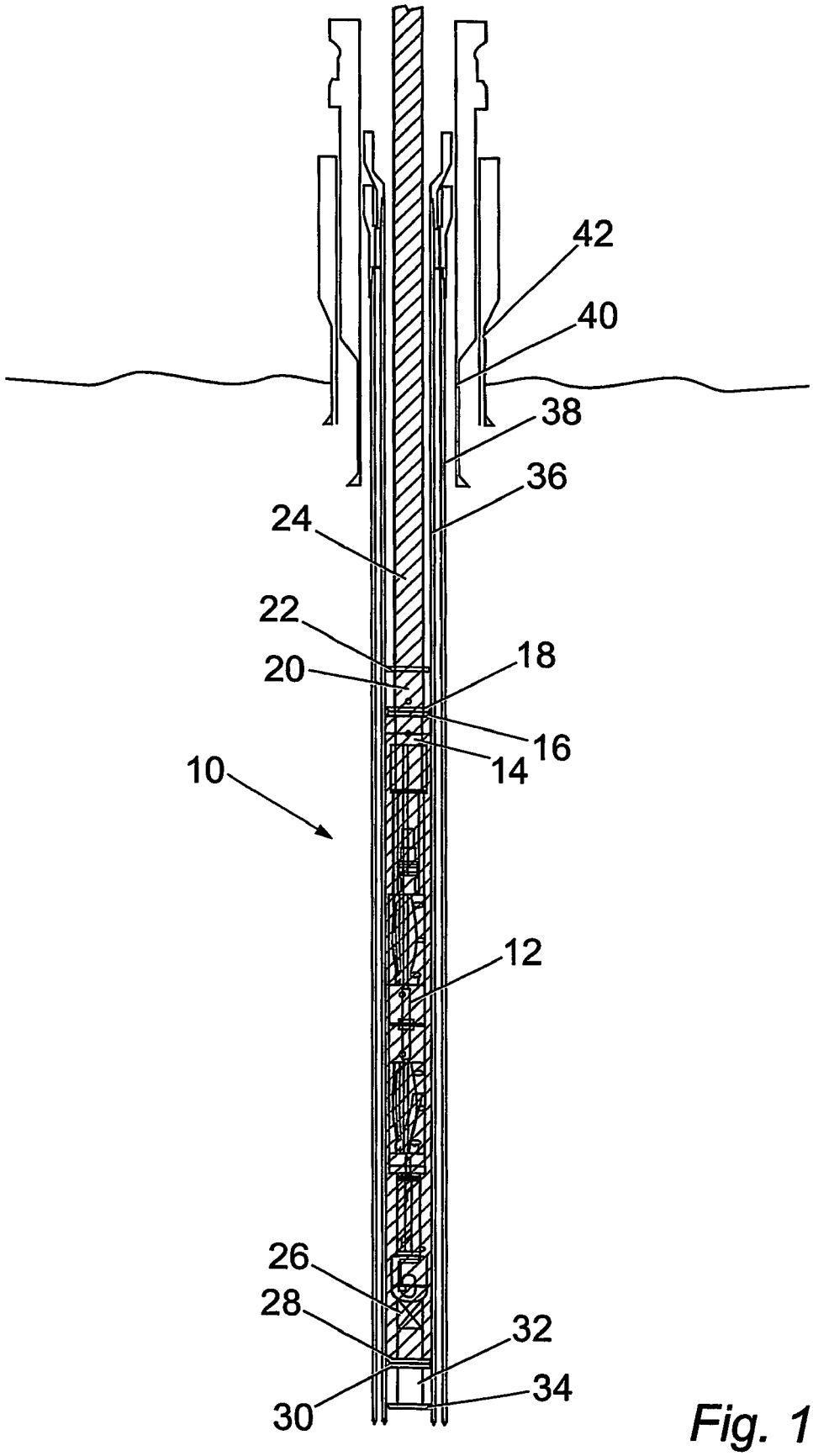
FIG. 1 shows a partial cross-section of an abandonment string inserted into a wellbore to be abandoned.

As shown in FIG. 1, an abandonment string 10 typically comprises a cutting tool 12, a first circulating sub 14, two oppositely orientated cup-type seal assemblies 16 18, a second circulating sub 20, a third cup-type seal assembly 22 and drill pipe 24.

Figure 14:
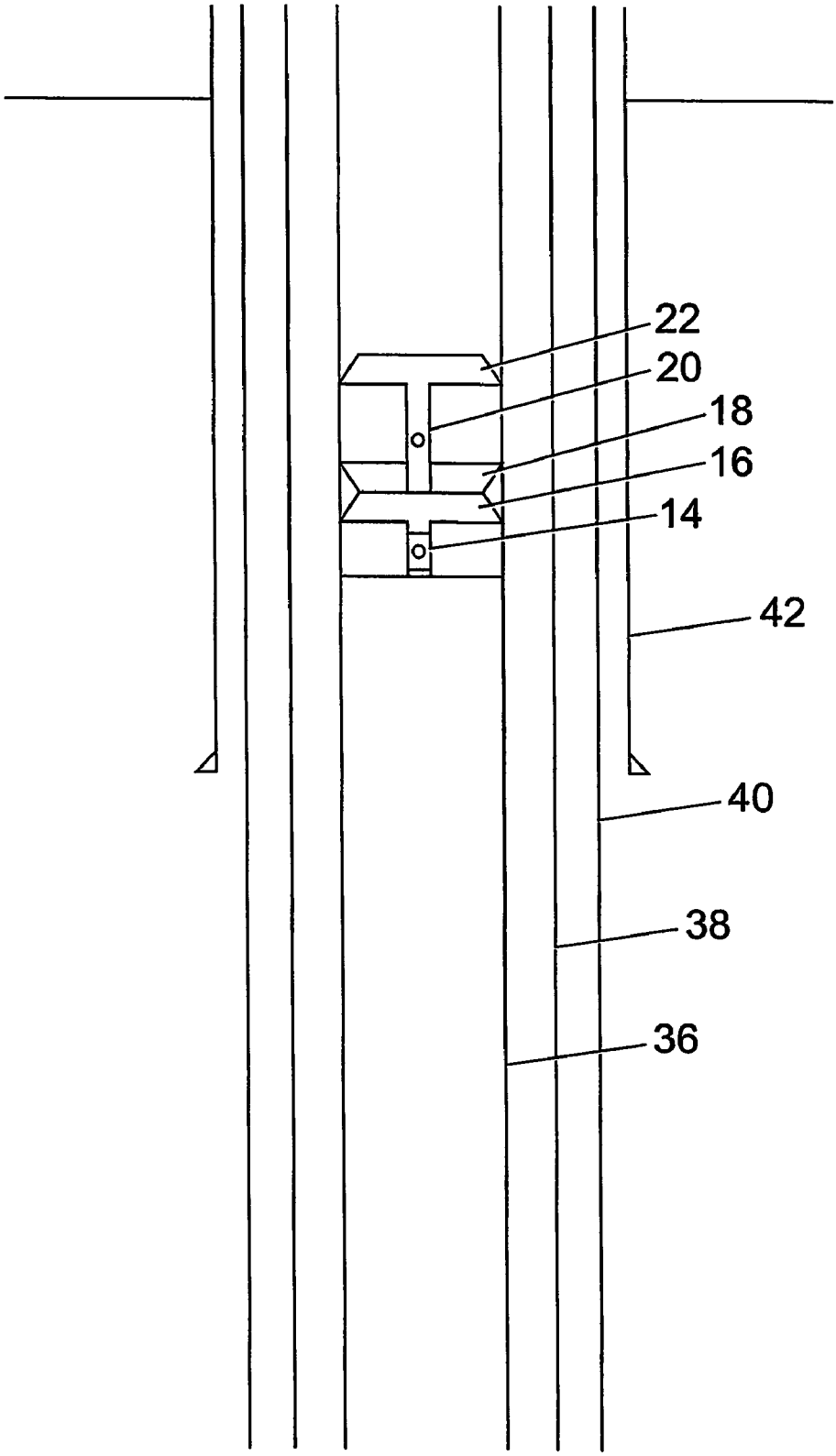
FIG. 14 shows a cross section of three cup-type seal assemblies mounted on two circulating subs.

An enlarged view of cup-type seal assemblies 16, 18, 22 and circulating subs 14, 20 is shown in FIG. 14. Cup-type seal assemblies 16 and 22 provide two permanent barriers between the hydrocarbon bearing formation and the surface.

Optionally, a second cup-type seal assembly and sub arrangement may be provided beneath the cutting tool 12. This could be useful if the plug 44 in the innermost casing has not formed a perfect seal. As shown in FIG. 1, the arrangement could comprise a sub 26, fourth and fifth cup-type seal assemblies 28,30 arranged back-to-back, a further sub 32 and a sixth cup-type seal assembly 34. This cup-type seal assembly and sub arrangement is inverted as compared with the arrangement above the cutting tool 12, except that the subs 26 and 32 can be ordinary subs instead of circulating subs. It is not necessary to have this entire arrangement; cup-type seal assembly 28 would be sufficient, or cup-type seal assemblies 28 and 34, if a double seal is required.

Figure 15A:
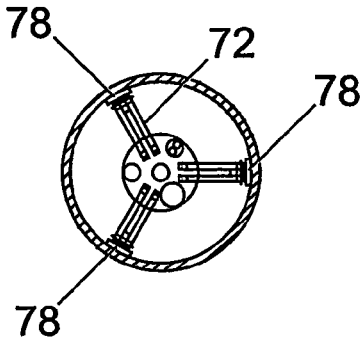
FIG. 15 shows a side view of a cutting tool.
Figure 15B:
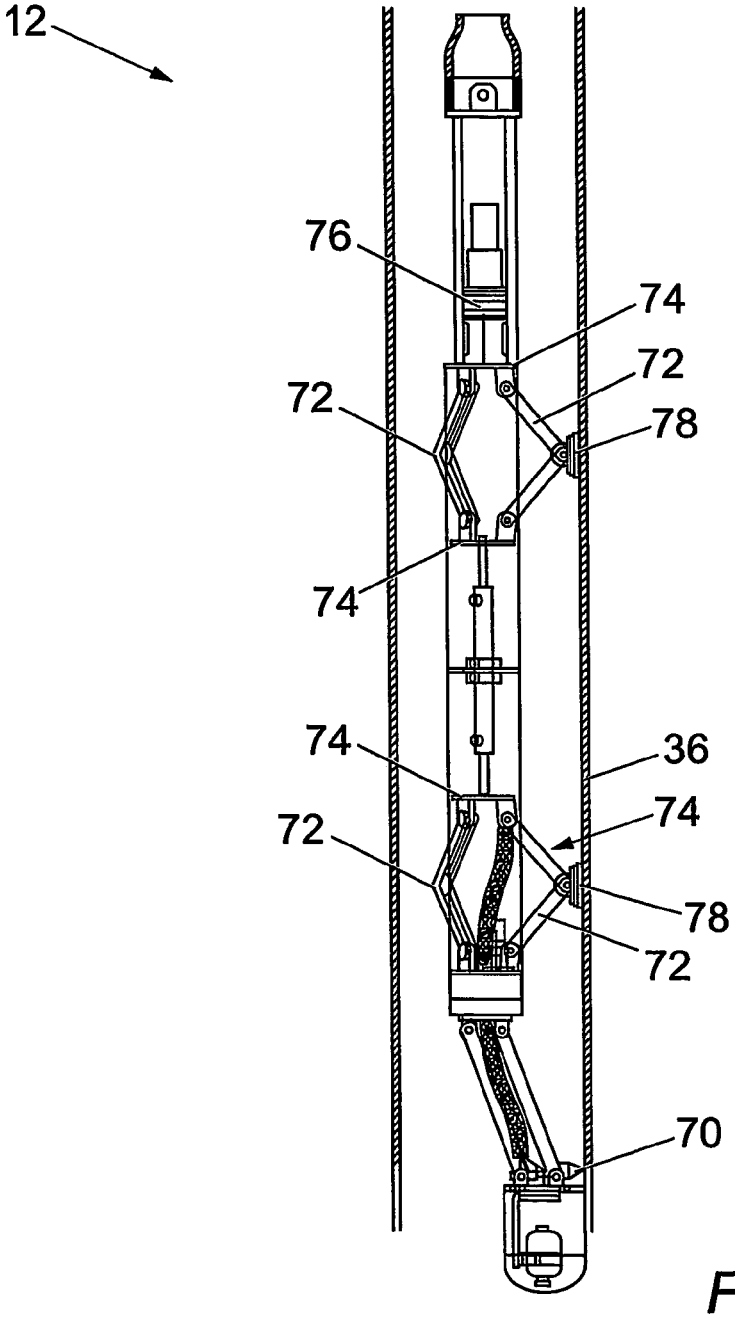
Figure 16:
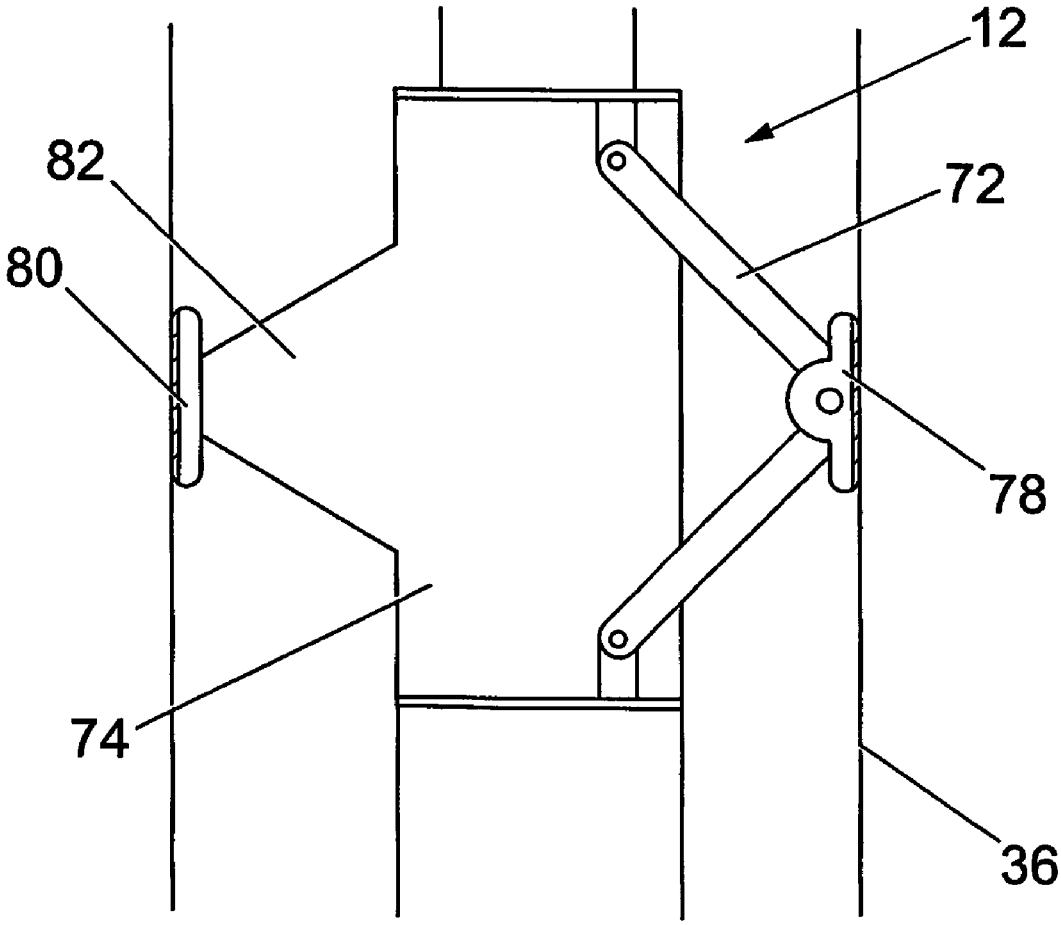
FIG. 16 shows a side view of a portion of a cutting tool.

The cutting tool 12 is best shown in FIGS. 15 and 16. It has a rotatable jet cut nozzle 70, which can cut through casing 36. Cutting nozzle 70 is rotatable in both horizontal and vertical planes to allow the cutting of communication ports (i.e. cutting nozzle can cut in two dimensions). Cutting tool 12 has a pair of anchoring devices 74 that are axially spaced along the body of the tool, to anchor the tool 12 in the casing 36. Each anchoring device 74 has three feet 78 that are circumferentially spaced around the body of the tool 12 and each foot is attached to the body of the tool 12 by a pair of link arms 72 that are each pivotally coupled at one end to an eye on the foot and at the other end to a respective eye on the body. One of the eyes on the body is mounted on a central plate that is driven axially by a hydraulic ram to push the eyes on the body together thereby extending the feet by means of the pivotal connections so that the feet move laterally to contact the casing 36. FIG. 16 shows one embodiment of a part of cutting tool 12, which has a foot 78, mounted on a pair of link arms 72. The foot 78 typically has an abrasive outer surface with e.g. serrations so that there is high friction between the foot 78 and casing 36 when the two are in contact. FIG. 16 also depicts an optional second foot 80, which is mounted on an extension 82 of the body of the cutting tool 12. The cutting tool should have at least one extendable foot 78, and optionally at least one other foot 78 or 80, or other high friction casing contacting surface. Typically there are two or three feet 78 each circumferentially mounted on pairs of linking arms 72 which are circumferentially spaced around the tool 12. As shown in FIG. 15, more than one plate 74 may be provided.

The drill pipe 24 extends to the surface. Umbilicals also extend from the surface to the cutting tool 10.

The abandonment string 10 is shown inside a wellbore, which has several layers of casing: 9⅝", 13⅜", 20" and 30", which are respectively designated by numbers 36, 38, 40 and 42.

Figure 17:
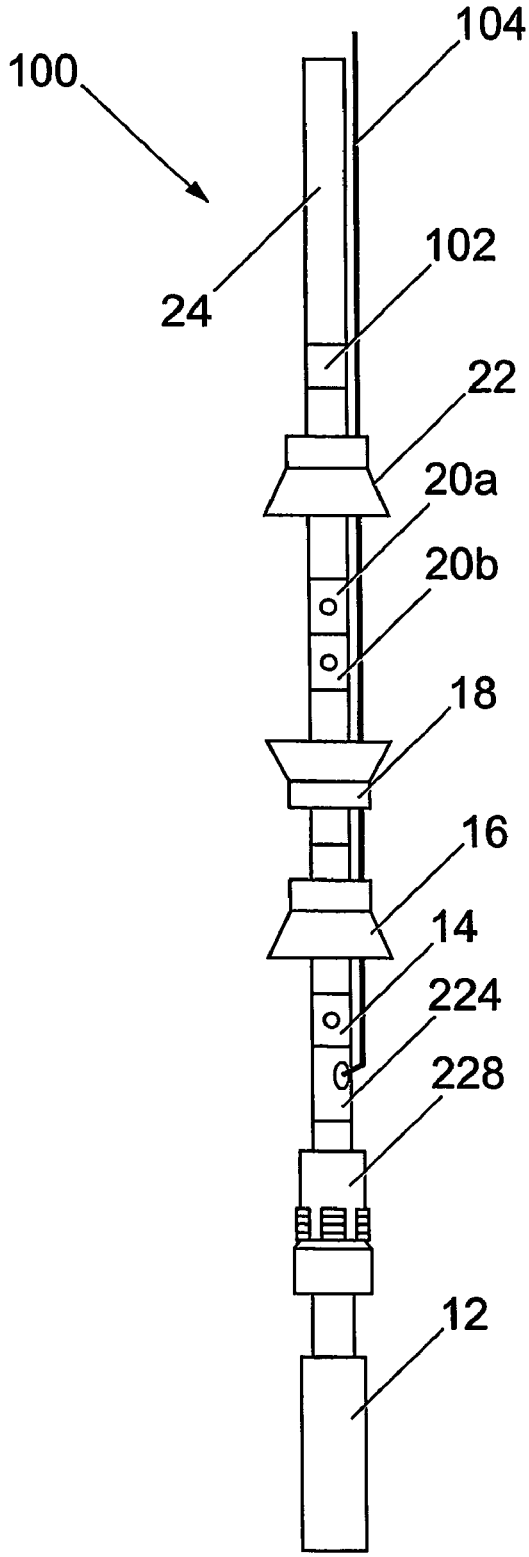
FIG. 17 shows a schematic diagram of an abandonment string.
Figure 18:
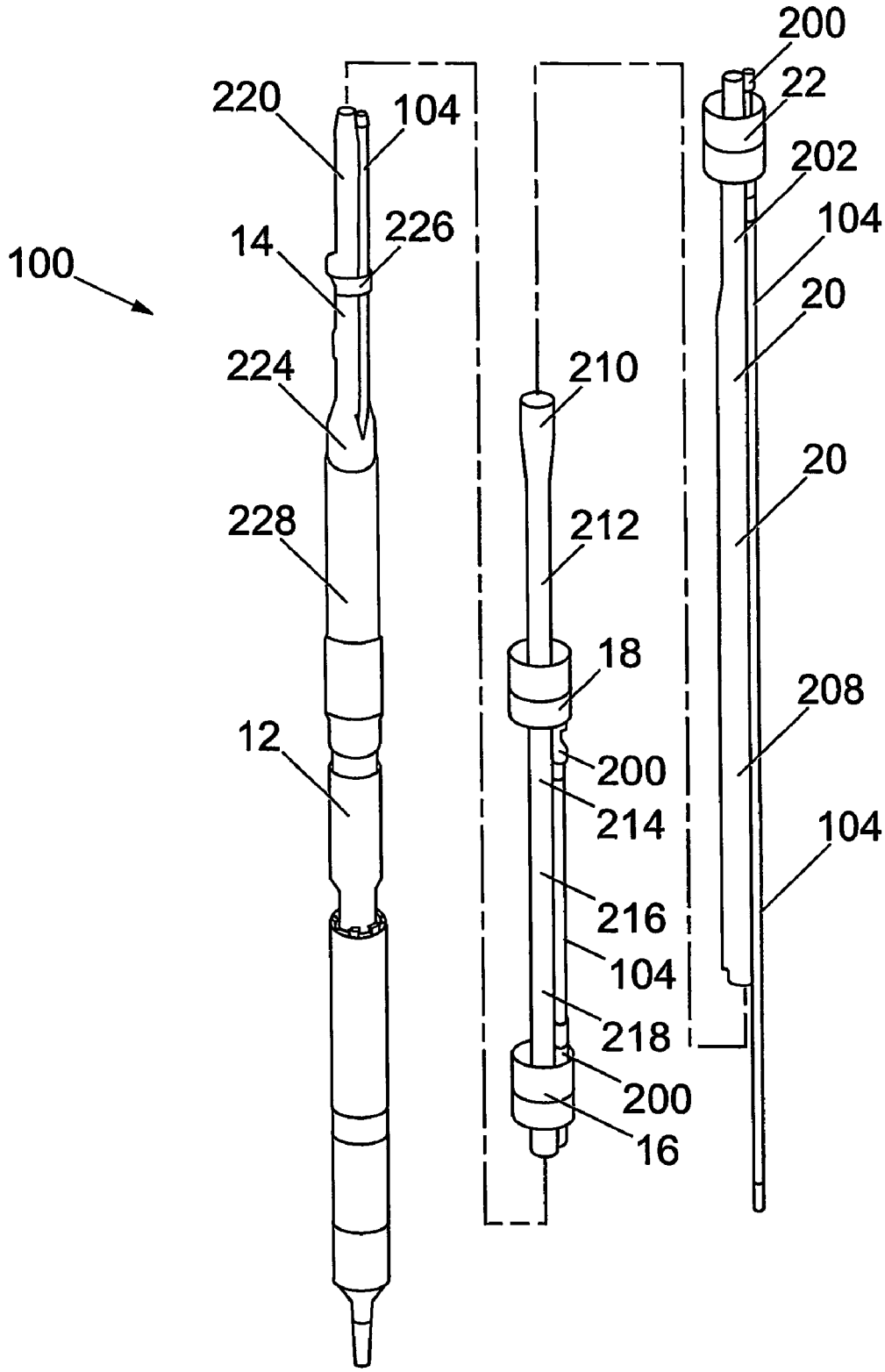
FIG. 18 shows a perspective view of the abandonment string of FIG. 17.
Figure 19:
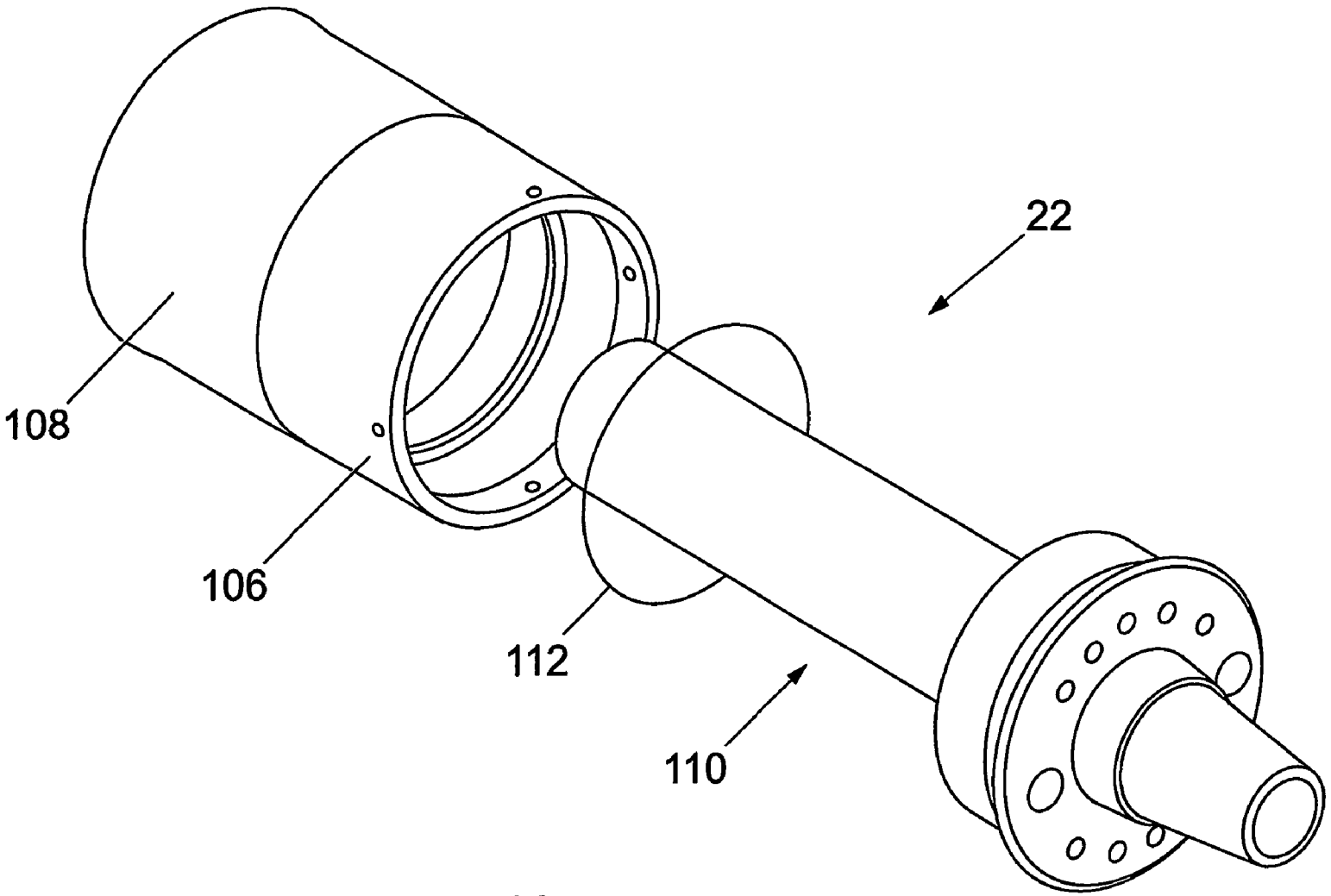
FIG. 19 shows a perspective view of a cup-type assembly.
Figure 20:
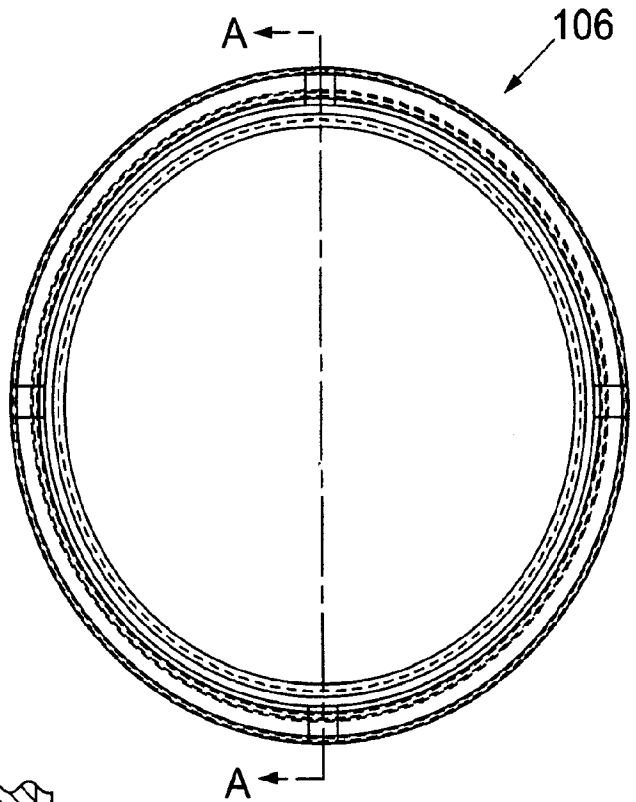
FIG. 20 shows an end view of a body member of the cup-type assembly of FIG. 19.
Figure 22:
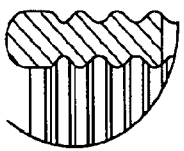
FIG. 22 shows an enlarged view of circle B of FIG. 21.
Figure 21:
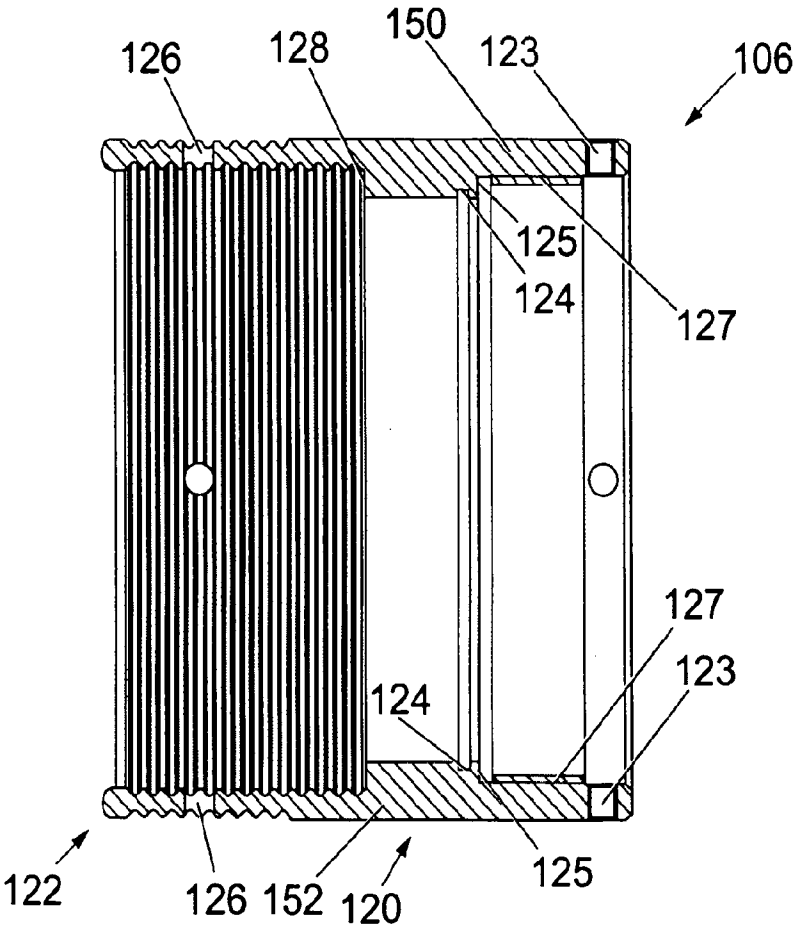
FIG. 21 shows a cross-section along the line A-A of FIG. 20.
Figure 23:
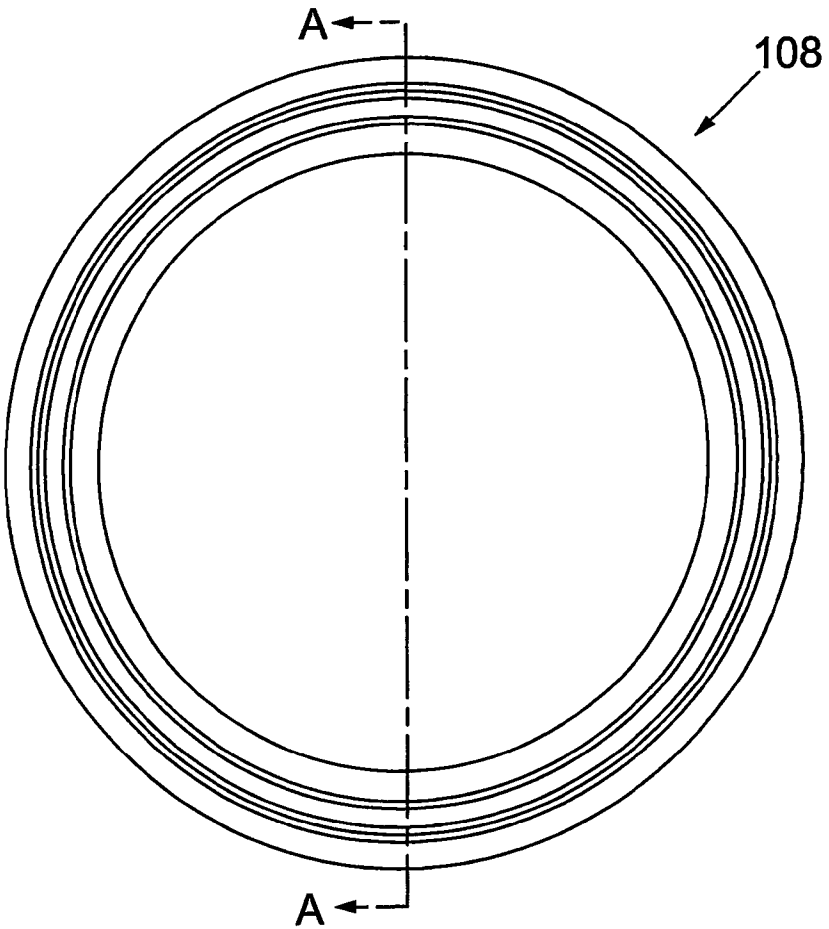
FIG. 23 shows an end view of a cup-type seal of FIG. 19.

FIGS. 17 and 18 show a second embodiment of abandonment string 100 and like parts are designated by like numbers. Abandonment string 100 differs from abandonment string 10 in that cup-type seal assemblies 16 and 18 are shown separated by subs, whereas in FIG. 10, these are shown back to back.

Like the FIG. 1 embodiment, abandonment string 100 is run on drillpipe 24. Starting from the top of the string, the first component is an optional safety joint 102. This provides a means of disconnecting drillpipe 24 from abandonment string 100 should the need arise.

A flex pipe 104 runs along the side of drillstring 24 and the rest of abandonment string 100. Flex pipe 104 typically comprises a ¾ inch 15K fluid power hose to supply fluid (slurry) to cutting tool 12. Also running along the side of drillstring 24 parallel to flex pipe 104 are electrical and hydraulic umbilical lines (not shown) to power and control the cutting tool 12.

The next component in the string is cup-type seal assembly 22 and associated flex pipe assembly 200. Cup-type seal assembly 22 is shown in more detail in FIGS. 19 to 28. Cup-type seal assemblies 16, 18 further down the string are typically exactly the same, but for ease of reference numbering, the cup-type seal assembly is denoted simply as 22.

Cup-type seal assembly 22 includes a body member 106, a seal 108, a shaft assembly 110 and an o-ring seal 112. Body member 106 is substantially cylindrical. It has a shaft-engaging portion 120 and a seal-engaging portion 122. Shaft-engaging portion 120 has a smooth outer surface of constant diameter. Shaft-engaging portion 120 is divided into two portions with different inner diameters; an end portion 150 of diameter 188 mm and a mid portion 152 of diameter 175 mm; end portion 150 and mid portion 152 are divided by a step 125, which lies at 53 mm from the end of body member 106. It should be noted that throughout this specification all dimensions are exemplary rather than limiting The outer end of the end portion 150 is provided with four holes 123 equally spaced around the circumference for the insertion of grub screws. Adjacent to holes 123, end portion 150 has 7.375-6 ACME-2G threads 127 which terminate a short distance before step 125.

Mid portion 152 is provided with a groove 124 to accommodate o-ring seal 112. Mid portion 152 then continues uniformly up to a distance of 92 mm from the end of the shaft-engaging portion 120, where there is a further step 128 which marks the boundary between the shaft-engaging portion 120 and the seal-engaging portion 122.

The seal-engaging portion 122 comprises an extension of the shaft-engaging portion and is provided with undulations on both of its inner and outer surfaces. The seal-engaging portion 122 is thinner than the shaft-engaging portion 120, having a larger inner diameter and the same outer diameter. Eight radial apertures 126 are provided in the seal-engaging portion 122, equally spaced around the circumference; more or fewer apertures could be provided here, or even none at all.

Figure 24:
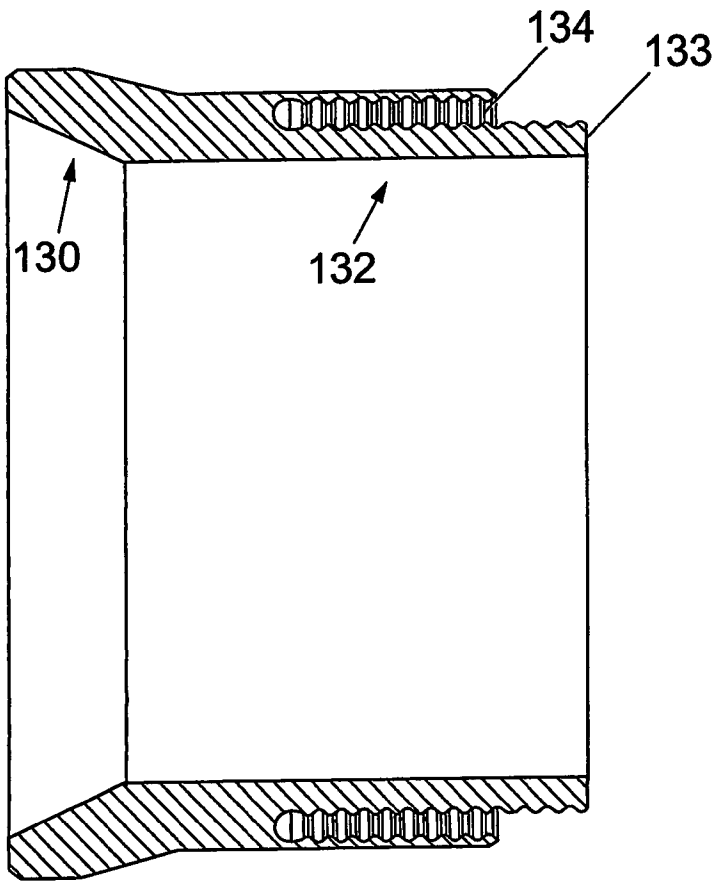
FIG. 24 shows a cross-section along the line A-A of FIG. 23.
Figure 25:
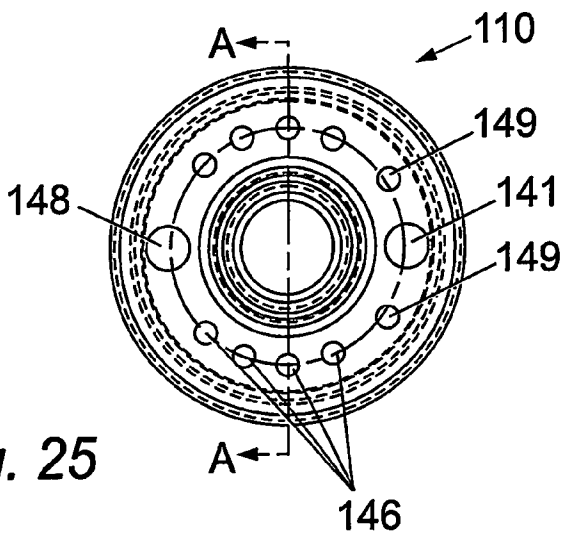
FIG. 25 shows an end view of a shaft of the cup-type seal assembly of FIG. 19.
Figure 26:
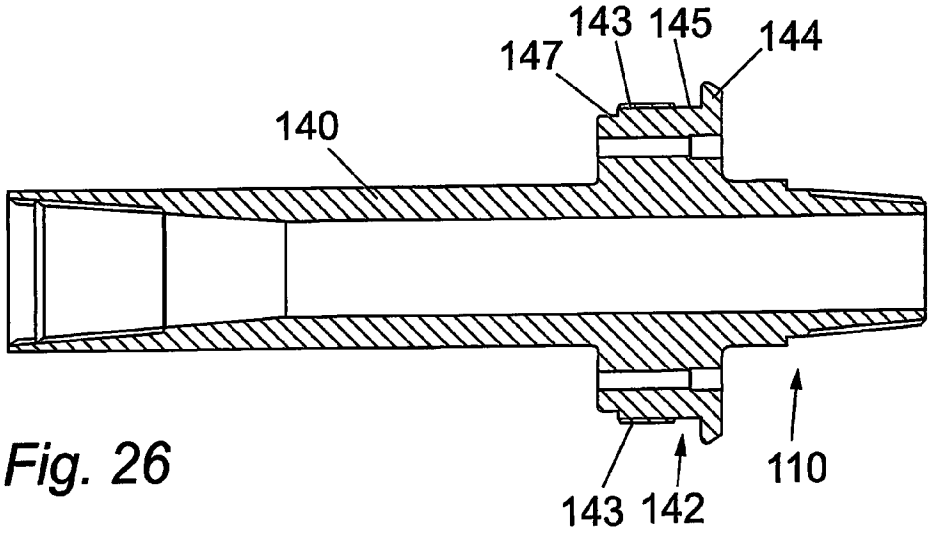
FIG. 26 shows a cross-section along the line A-A of FIG. 25.
Figure 28:
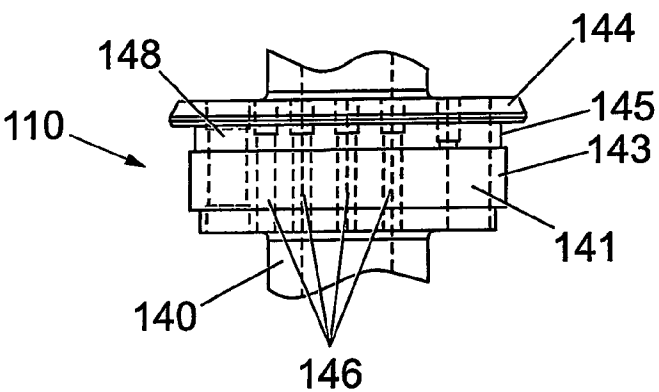
FIG. 28 shows a side view with interior detail of a flange of the shaft of FIG. 25
Figure 27:
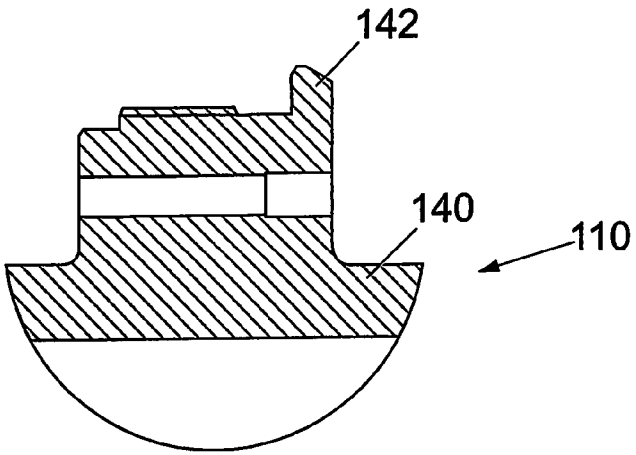
FIG. 27 shows an enlarged view of region B of FIG. 26.

Seal 108 is best shown in FIGS. 24 and 25. Seal 108 is also basically cylindrical with a body-engaging portion 132 and a radially-extending end 130. Body-engaging portion 132 is shaped to co-operate with the seal-engaging portion 122 of body member 106. Body-engaging end 132 of seal 108 is provided with a cylindrical recess 134 corresponding to the seal-engaging end 122 of body member 106, i.e. the cylindrical recess 134 has undulating inner and outer surfaces adapted to co-operate with the undulations on seal-engaging end 122. Seal 108 is coupled to body member 106 by the seal-engaging end 122 of body member 106 engaging the co-operating cylindrical recess 134 of seal 108, with end 133 of seal 108 abutting against step 128 of body member 106; the undulations act to resist separation.

Radially-extending end 130 is an extension of a body-engaging end 132 and it tapers outwards from body-engaging end 132, with both the inner and outer diameters increasing. The inner diameter increases at a greater rate than the outer diameter, so that the radially-extending end 130 gets thinner as it tapers outwards.

Seal 108 is preferable made of a rubber composition, preferably 70-80 durometer Nitrile which is suitable for hydrocarbon use; however other materials could also be used.

Shaft assembly 110, as best shown in FIGS. 25 to 28 includes a hollow shaft 140 and flange 142 extending outwardly of shaft 140. The shaft 140 has a box and a pin connection on respective opposite ends. Flange 142 is shaped to engage and co-operate with the shaft-engaging end 120 of body member 106. Flange 142 is provided with 7.375.6 ACME-2G screw threads 143 on its outer surface for connection with screw threads 127 on body member 106. Flange 142 has a radial projection 144 on the end of flange 142 closest to the pin connection, and a stepped recess 147 on the opposite end of flange 142. Between radial projection 144 and threads 143 is an unthreaded gap 145.

Flange 142 is provided with eight passages 146 of 11.8 mm diameter extending through flange 142 parallel to the axis of shaft assembly 110. Passages 146 are threaded at their upper and lower ends for the first 20 mm for engagement with respective bulkhead connections (not shown). One bulkhead connection is supplied for each end of each passage 146. Passages 146 are to enable the electrical and hydraulic umbilical lines to continue past cup-type seal assembly 22; each umbilical line terminates at the first bulkhead connection, the first bulkhead connection provides a continuation of the umbilical line through respective passage 146 to the second bulkhead connection on the opposite side of flange 142, which is in turn connected to a further umbilical line on the other side of flange 142. The bulkhead connectors can each be sealed closed, so that if any passage 146 is not being used, the respective bulkhead connectors are sealed so that no fluids can get through that passage 146.

Two further passages 141, 148 of larger (25.4 mm) diameter are provided in flange 142. Passages 141, 148 are threaded for the first ⅝ inches at their upper and lower ends.

Passage 141 allows the flex pipe 104 to continue through flange 142. Passage 141 also has a bulkhead connection, in the form of flex pipe assembly 200. Flex pipe assembly 200 is a means of connecting a portion of flex pipe 104 on one side of cup-type seal assembly 22 to a further portion of flex pipe 104 on the other side. Flex pipe assembly 200 typically includes a further portion of flex pipe 104 which passes through passage 141 in flange 142; flex pipe assembly 200 typically includes one or more seals (not shown) to seal between the exterior of flex pipe 104 and the interior of passage 141.

Two blind passages 149 are also provided in the flange, equally spaced on either side of passage 141. Blind passages 149 are typically used to receive bolts to secure flex pipe assembly 200 to shaft assembly 110.

Remaining passage 141 also has a bulkhead connection on each side of flange 142. Passage 141 can be used to accommodate a return fluid line or an extra flex pipe for slurry (not shown) or alternatively, if not used, it could be sealed closed at its bulkhead connections.

Passages 141, 146, 148, 149 are circumferentially distributed on flange 142.

Referring back to FIG. 18, cup-type seal assembly 22 is orientated in the string 100 with the seal end (and the box connection of shaft assembly 110) pointing downwards. The pin of shaft assembly 110 is attached to drillstring 24 as shown in FIG. 17.

When fluid flows into the seal end of cup-type seal assembly 22 (i.e. fluid flowing upwards on the outside of string 100 in this embodiment) the radially-extending end 130 of seal 108 is pushed outwards to engage the casing wall. The greater the pressure from the fluid, the more the radially-extending end 130 is pushed against the casing, and the better the seal. Therefore, fluid flowing upwards in the annulus between the string 100 and the innermost casing string cannot get past seal 22.

The box of shaft assembly 110 is attached to a pin-pin sub 202, followed by a crossover sub 204, two pin-box ported subs 20*a*, 20*b*, a further cross-over sub 210 and a pin-box sub 212. (Note that in this embodiment, there are two pin-box ported subs 20, whereas in the FIG. 1 embodiment only one was shown).

At this point in the string is cup-type seal assembly 18; this is exactly the same as cup-type seal assembly 22 and the above description of cup-type seal assembly 22 is equally applicable here. However, the orientation of cup-type seal assembly 18 is the reverse of the former seal assembly 22; i.e. where cup-type seal assembly 22 has its seal 108 pointing downwards, cup-type seal assembly 18 has its seal pointing upwards. Thus, in this case, it is the box connection of shaft assembly 110 that is attached to pin-box sub 212. Because of the opposite orientation, fluid flowing downwards in the annulus between string 100 and the innermost casing, is stopped by cup-type seal assembly 18.

Also as described above, a further flex pipe assembly 200 allows flex pipe 104 to pass through passage 141 in flange 142 whilst forming a seal around the outside of the passage.

The pin connection of shaft assembly 110 is attached to pin-box sub 214 and the drillstring continues with box-box sub 216 and further pin-box sub 218.

A further cup-type seal assembly 16 and respective flex pipe assembly 200 is attached to pin-box sub 218. Cup-type seal assembly 16 is exactly the same as cup-type seal assemblies 18, 22 described above, and has the same orientation in the string as cup-type seal assembly 22 (i.e. opposite to assembly 18). Thus, cup-type seal assemblies 16, 22 both act to prevent fluid flowing upwards from the well to the surface.

Connected to shaft assembly 110 of cup-type seal assembly 16 is a pin-pin sub 220 and pin-box ported sub 14. Pin-box ported sub 14 has a blind ending, and three transverse passages (although only one is necessary) leading from an inner bore to the outside of abandonment string 100, providing fluid communication with the outside of the string 100. Ported sub 14 allows for pressure testing beneath cup-type seal assembly 16, circulating through perforations as required and pressure monitoring during perforations. It also allows a fluid return path (via the drillpipe 24) for the cutting tool power fluid whilst cutting operations are in progress. Furthermore, bullheading the perforated casing annuli can be carried out via sub 14. Shield bracket 226 is provided on sub 14. The next element is apertured sub 224, which has at least one side aperture to allow the entry of flex pipe 104 into a hollow bore of apertured sub 224. Apertured sub 224 may also have a further aperture for entry of a further fluid return pipe (not shown) into the hollow bore.

Figure 29:
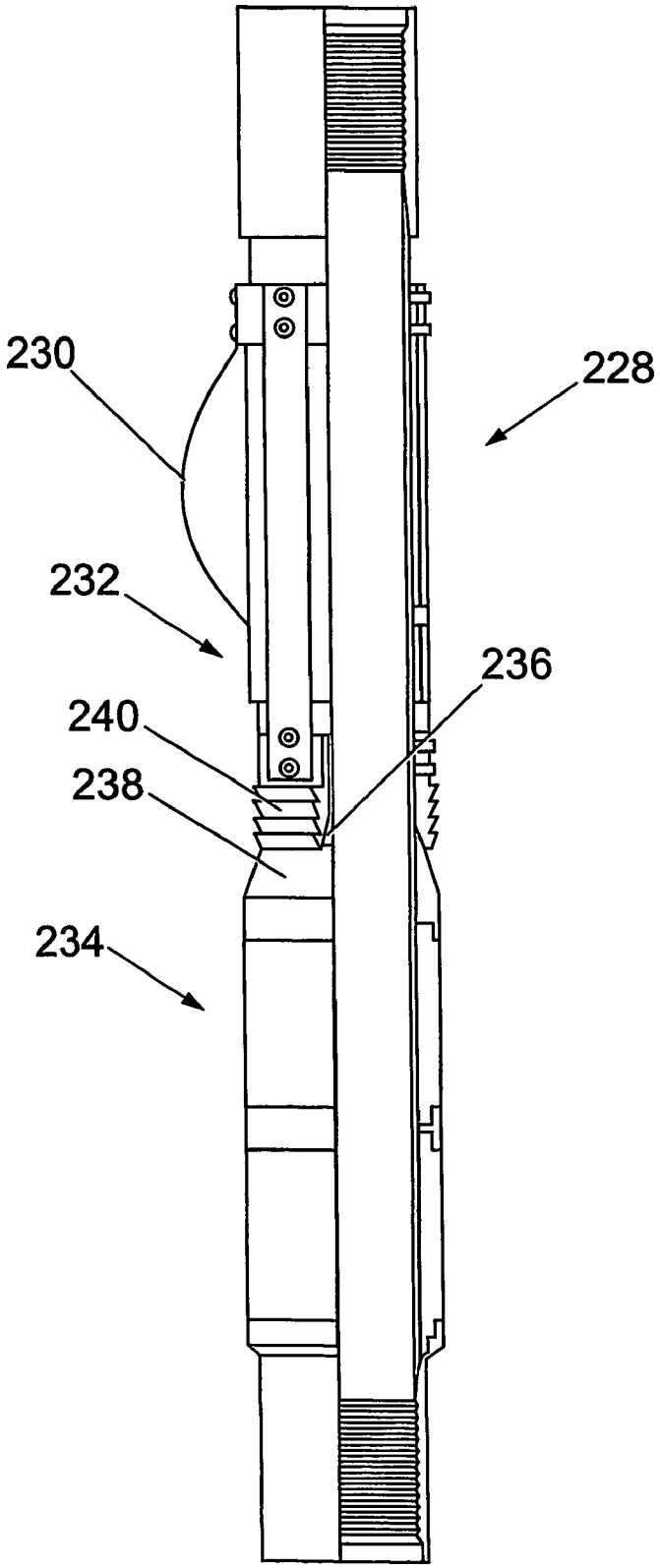
FIG. 29 shows a side view of the anchor of FIGS. 17 and 18.

Attached to apertured sub 224 is anchor sub 228; this is best shown in FIG. 29. Anchor sub 228 replaces the anchoring device 74 shown in FIGS. 15 and 16 (used in abandonment string 10). Anchor sub 228 is a modification of a casing packer. The modification typically includes the removal of the inner packing material, leaving a central hollow bore for the passage of flex pipe 104 and the umbilicals. Anchor sub 228 has a first portion 232 and second portion 234 which are slideable relative to each other; the second portion 234 having a tapered portion 238, which in turn has a reduced-diameter extension 236. The first portion 232 has grippers 240 on the end closest to the second portion. To activate anchor 228, the second portion 234 is moved upwards relative to first portion 232, which causes grippers 240 to be pushed radially outwards as they travel along tapered portion 238. Grippers 240 engage the inner surface of the cased wellbore to anchor abandonment string 100 to the casing.

Attached to anchor sub 228 is cutting tool 12, which can be the same anchoring tool as shown in FIG. 15. Cutting tool 12 in this embodiment does not need to have feet 78 as abandonment string 100 already has an anchor 228, although these may be still be provided if desired.

Cutting tool 12 has a hollow internal passage to allow passage of flex pipe 104 and the umbilical lines (not shown). Cutting tool 12 has a cutting nozzle 70 (see FIG. 15). The cutting tool 230 is controlled and powered by the umbilicals; fluid (typically slurry) is supplied to cutting nozzle 70 by flex hose 104. The remaining features of cutting tool 12 have already been described above with reference to FIG. 15 and the abandonment string 10 embodiment.

In use, when the corrosion cap/temporary abandonment cap has been removed from the well, a drill string with a rock bit is run into the wellbore, to check that it is free of obstructions. The drill string is typically made up of 3½" or 5" drill pipe.

The abandonment string 10, 100 is made up and run into the hole to a depth of typically 100-400 metres (in some cases up to several thousand metres) beneath the wellhead. The top drive is then made up or the string is connected to a circulation device.

With abandonment string 10, the cutting tool 12 in the string is then anchored to e.g. the 9⅝" optionally below the wellhead by extending the rams 72 so that the feet 78 contact the casing 36. The abandonment string 10 is thus held fixed relative to the casing 36 by friction between the feet 78 and the casing 36. If abandonment string 100 is used, anchor 228 is engaged as described above by moving second portion 234 towards first portion 232 until the grippers 240 grip the casing sufficiently.

Figure 7:
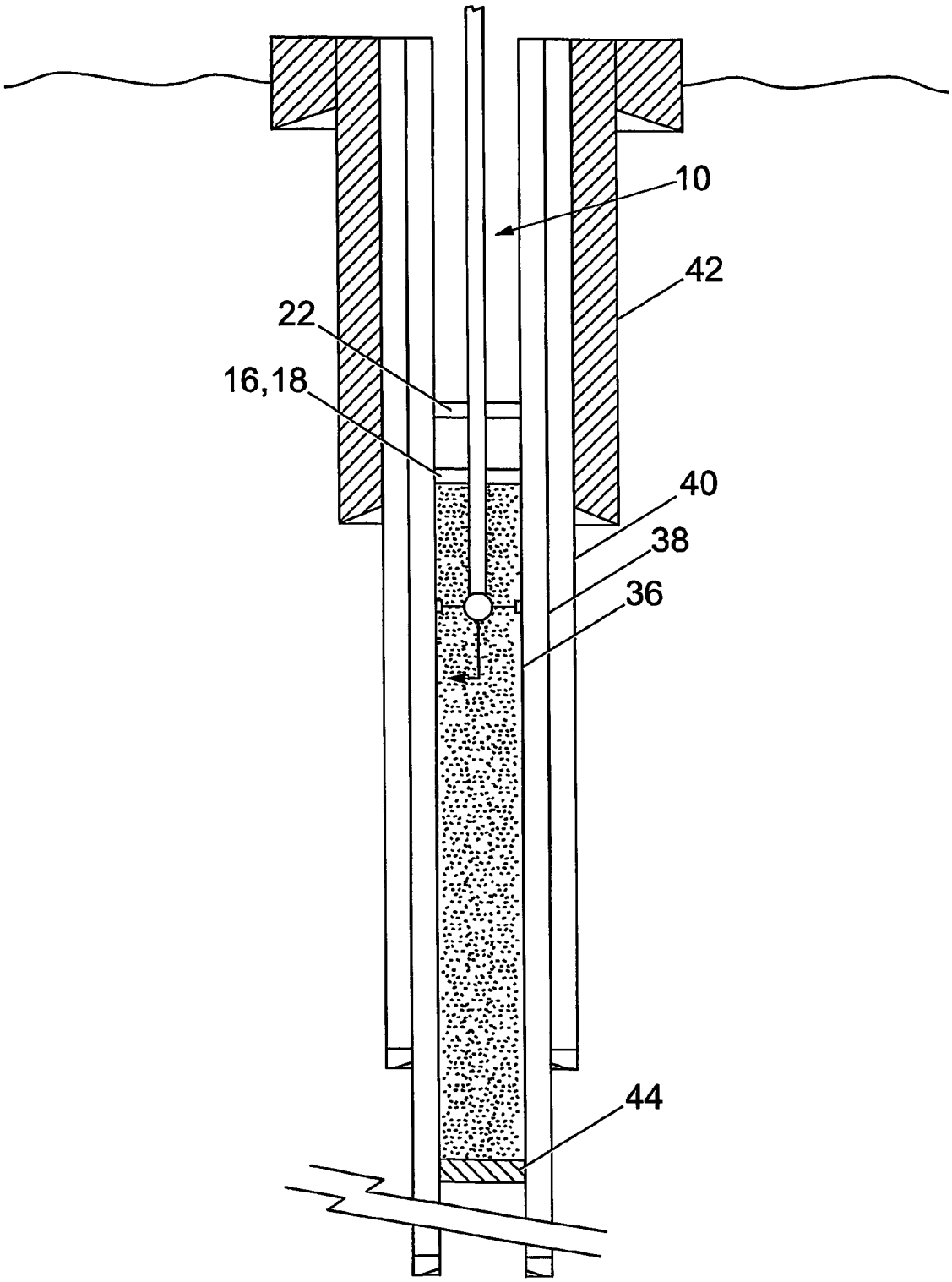
FIG. 7 shows a schematic cross-section of the abandonment string pressure testing the 9⅝" casing string.

As shown in FIG. 7, the casing 36 is pressure tested, to check its integrity. This is done by pumping fluid down through the abandonment string 10, 100 and out through an aperture in circulating sub 14. The fluid is constrained within the area bounded by an existing plug 44 (fitted when the wellbore was temporarily abandoned), the cup-type seal assemblies 16, 22 and the casing 36. This tests the pressure integrity of the casing and of the plug 44 and identifies whether there are any fissures through which significant amounts of hydrocarbons can leak from the formation.

It may be advantageous to only engage the anchor after the pressure has already begun to build up. The anchor is useful to prevent the pressure build up underneath cup-type seal assembly 16 from forcing abandonment string 100 out of the well.

Figure 2:
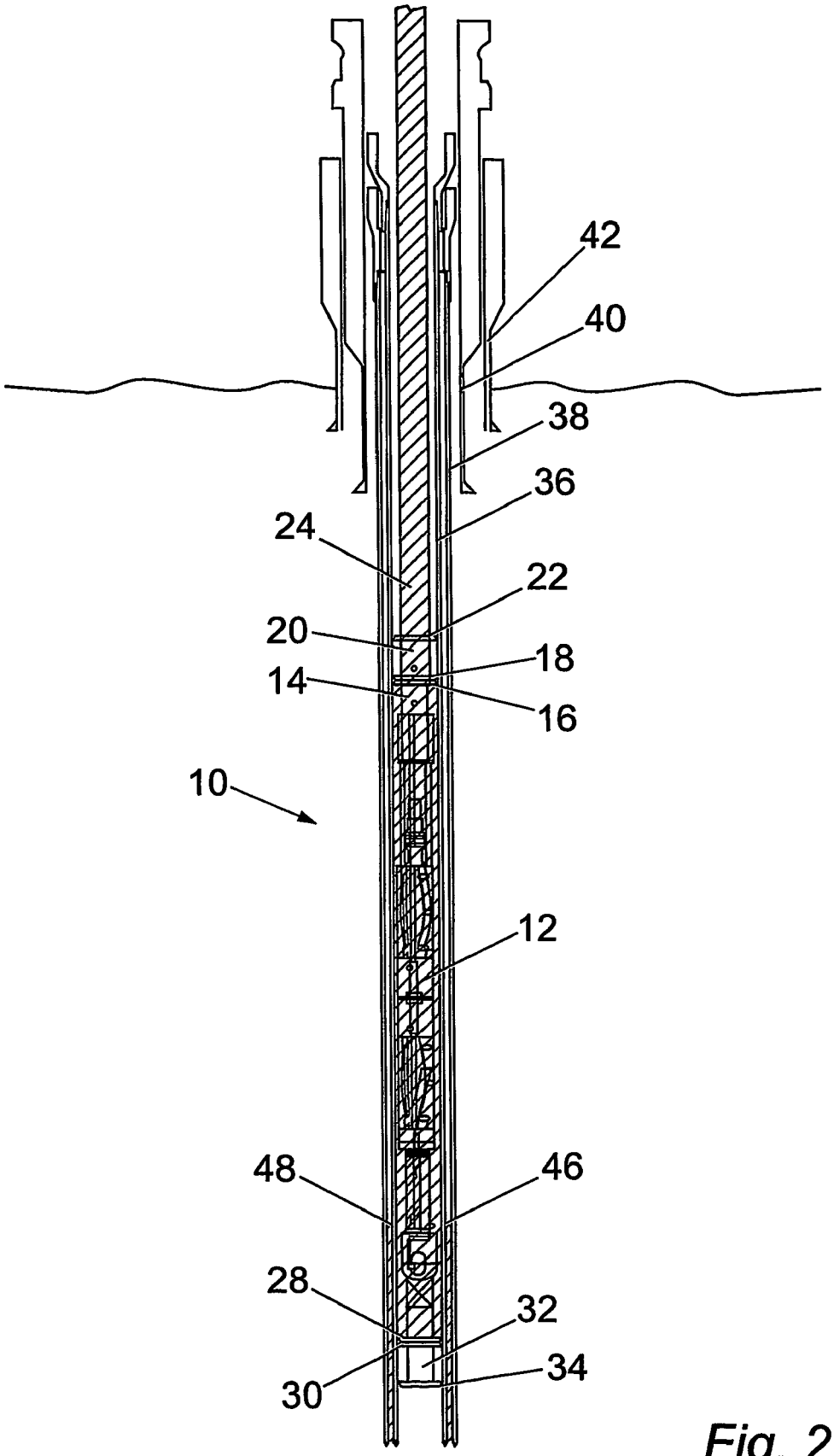
FIG. 2 shows a partial cross-section of the abandonment string piercing the 9⅝" casing.
Figure 8:
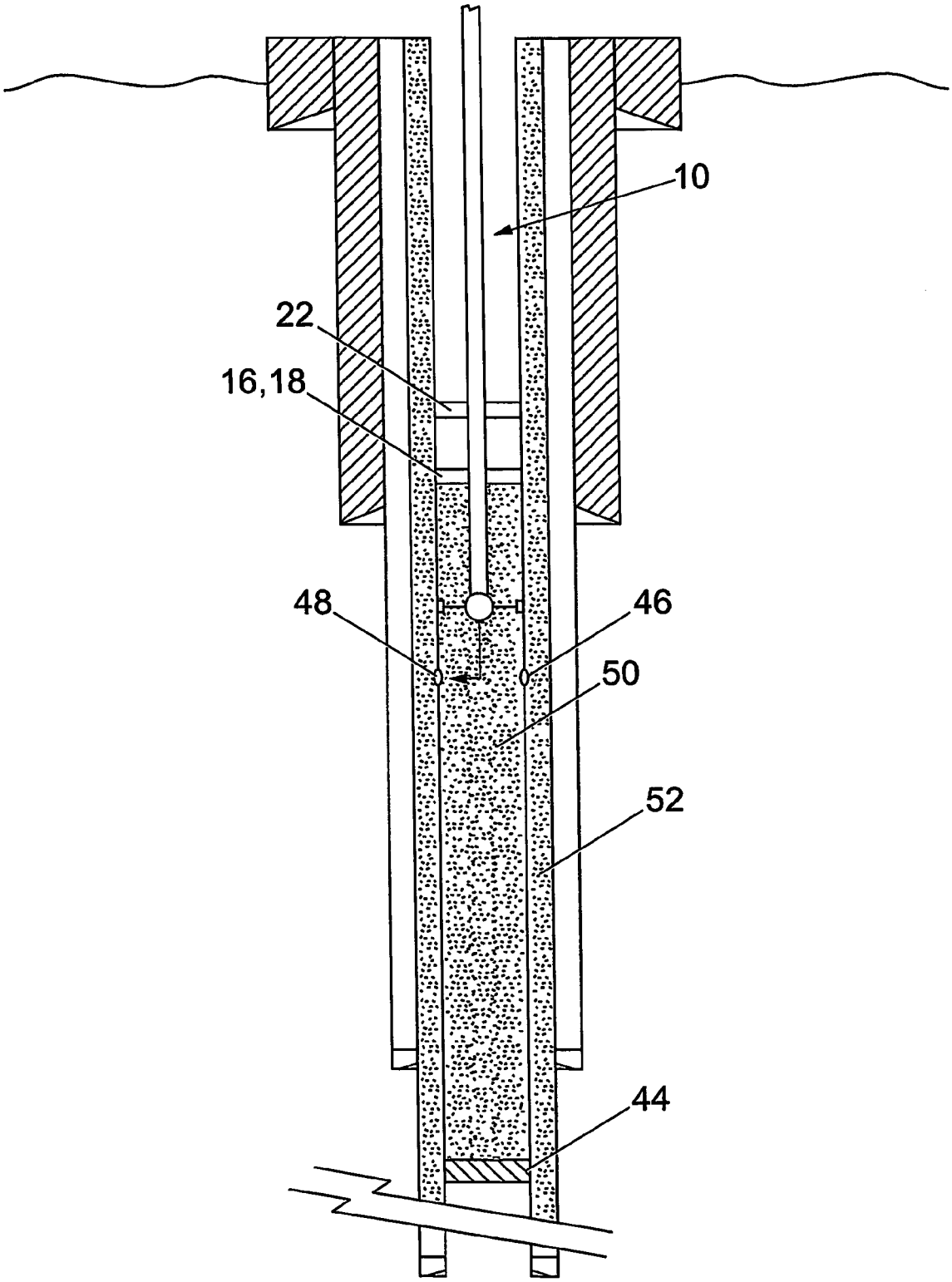
FIG. 8 shows a schematic cross-section of the abandonment string making a cut in the 9⅝" casing and pressure testing the annulus between the 9⅝" casing and the 13⅜" casing.

Assuming that the casing 36 and the plug 44 do not have any substantial leaks, the cutting tool 12 then cuts two (typically circular) holes 46, 48 in opposite sides of the casing 36, as shown in FIGS. 2 and 8. It is not necessary to cut two holes; one would suffice, nor is it necessary for the holes to be opposite each other.

A second pressure test is then performed by pumping fluid 50 (e.g. water) through the abandonment string and out through the aperture in circulating sub 14, in the same manner as the first pressure test. The fluid 50 passes out through the holes 46 and 48 and into the annulus 52 between the casing 36 and the casing 38. Some of the fluid 50 may escape down the annulus 52 and into the formation. The rate of pumping is varied so that equilibrium is reached between the amount of fluid 50 entering and leaving the annulus 52. The equilibrium rate of pumping and pressure are recorded. A typical equilibrium rate might be 2-3 barrels per minute at a pressure of 3,000 pounds per square inch. This test is done to establish a bench mark for the next pressure test. It also establishes the integrity of the casing 38; if there is very low pressure in the annulus 52 after pumping fluid 50 into it, that could indicate leaks in the casing 38 or the cement job. If there is a very high back pressure, which could be caused by hydrocarbons in the annulus/formation, the excess fluid will have to be removed via the string before proceeding.

Figure 3:
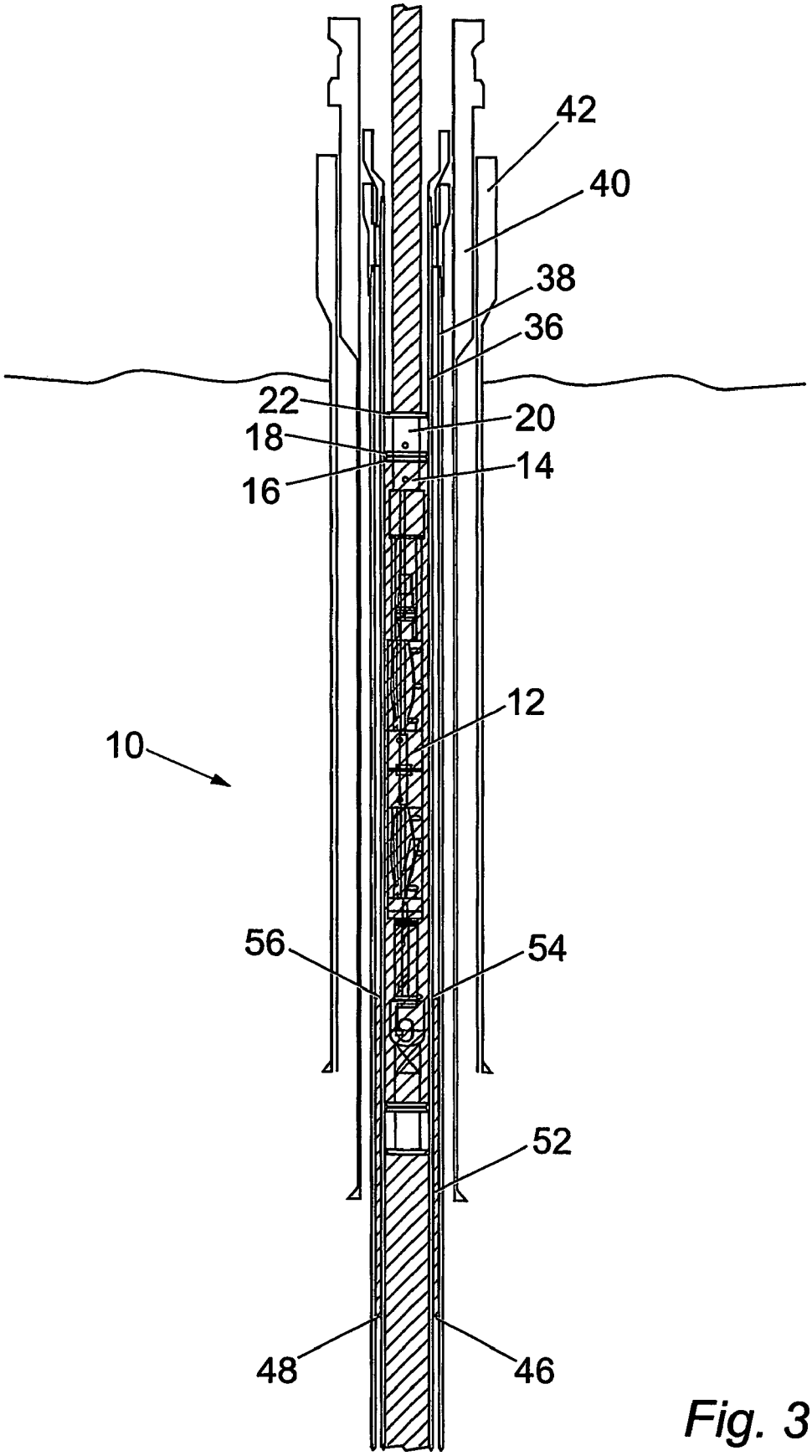
FIG. 3 shows a partial cross-section of the abandonment string making a second, higher cut in the 9⅝" casing.
Figure 4:
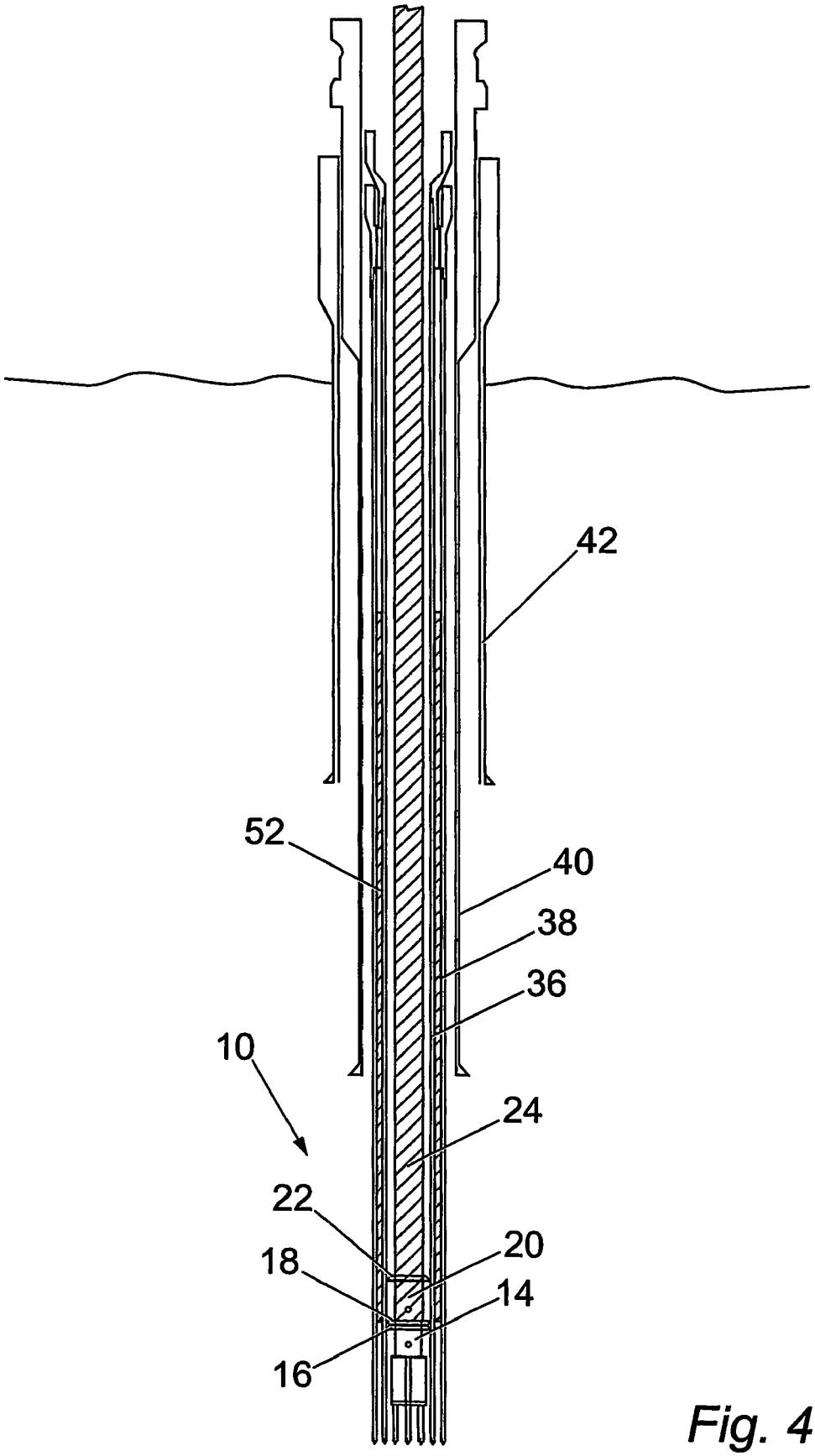
FIG. 4 shows a partial cross-section of the abandonment string injecting cement into the annulus between the cuts.
Figure 9:
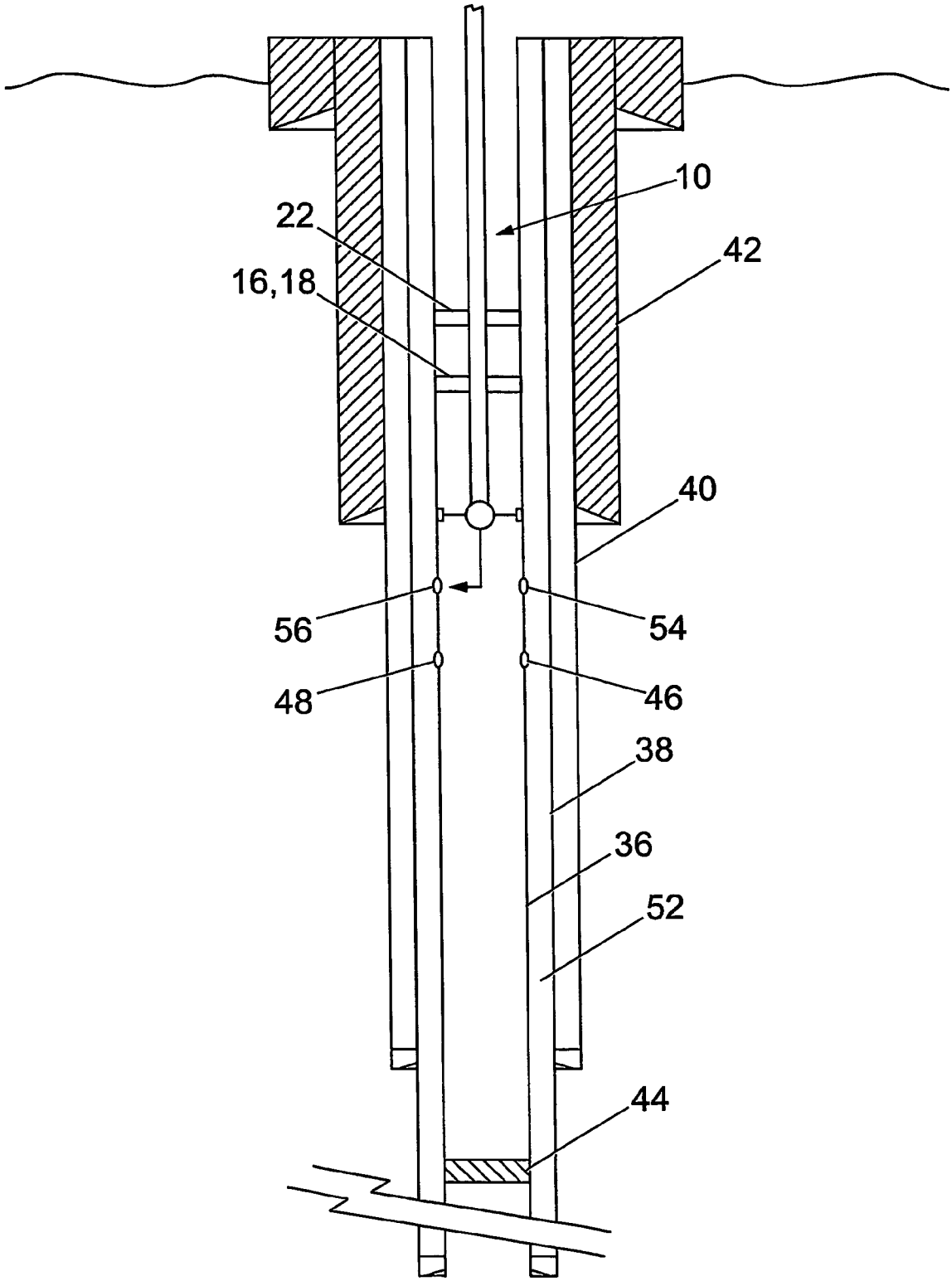
FIG. 9 shows a schematic cross-section of the abandonment string making a second cut in the 9⅝" casing.

The anchoring means are then deactivated to release the cutting tool 12 from the casing 36 and the abandonment string 10, 100 is then raised so that the cutting tool 12 is approximately 400-500 feet above the first cuts 46,48 as shown for example in FIGS. 3 and 9. The anchoring means are then reactivated so that the cutting tool 12 is re-anchored to the casing 36 (i.e. by extending the link arm 72 to push the feet 78, 80 against the casing 36 in the FIG. 1 embodiment, or by moving the first and second portions 232, 234 away from each other in the FIG. 17 embodiment). A pair of second cuts 54, 56 are made with the cutting tool 12 in opposite sides of the casing 36 as before. Again, it is not necessary to cut twice; one cut would suffice. In some cases a further pressure test as described previously can be carried out through the newly made cuts 54, 56, but this is not necessary.

Figure 10:
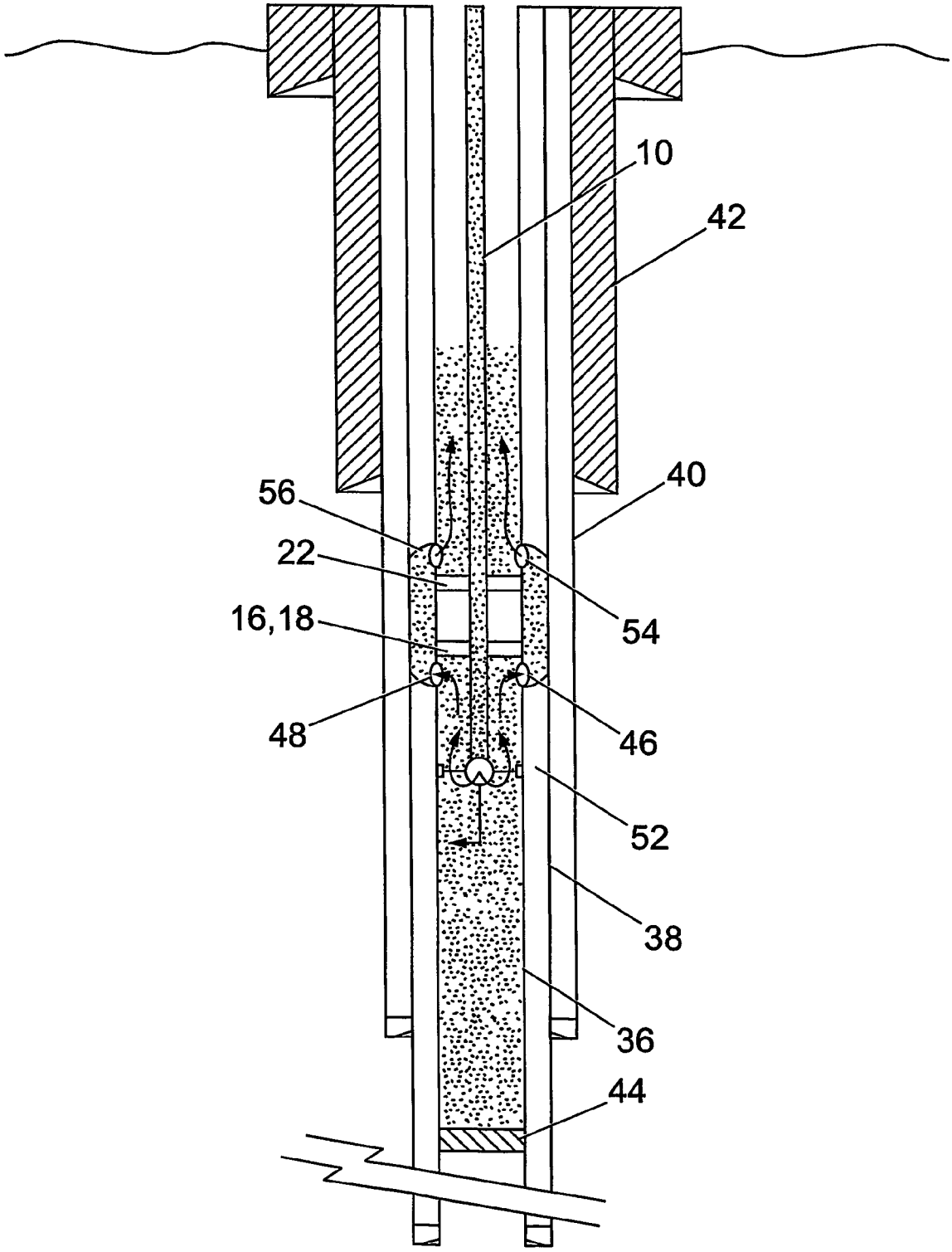
FIG. 10 shows a schematic cross-section of an integrity check of the cement in the annulus between the two cuts.

The anchoring device is then deactivated to release the cutting tool 12 from the casing and the abandonment string 10 is lowered down the borehole so that the cup-type seal assemblies 16 and 22 are between the two sets of cuts 46, 48 and 54, 56, as shown in FIG. 10. Fluid is then pumped from the lower sub through cuts 46, 48 and into the annulus 52 between the two sets of cuts 46, 48 and 54, 56. If the fluid pathway is open in the annulus 52, fluid pumped through the string 10 should flow through cuts 54, 56 without significant measurable pressure build up at surface.

Figure 11:
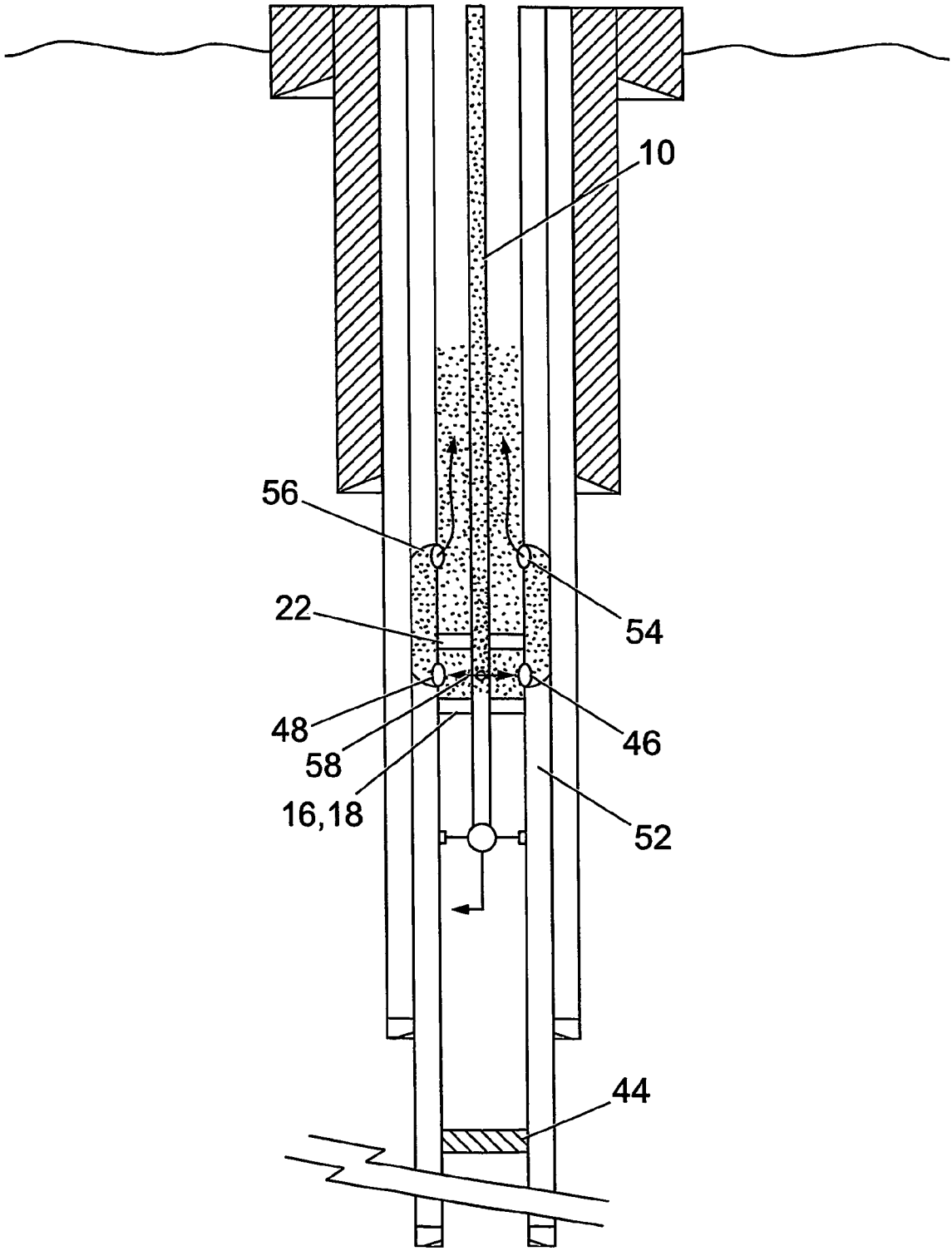
FIG. 11 shows a schematic cross-section of cement being injected into the annulus between the two cuts.

The abandonment string 10 is then detached from the casing, lowered and re-anchored so that the first cuts 46, 48 are positioned between cup-type seal assemblies 18 and 22, as shown in FIG. 11. A ball or dart is dropped through the abandonment string 10 so that it diverts fluid from the circulating sub 14. Cement is then pumped down the abandonment string 10. The cement 58 passes out of the hole 20 in circulating sub and into the annulus 52.

When no more cement can be pumped in at a reasonable rate and pressure (with reference to the readings taken earlier) this indicates that the annulus between the cuts is well sealed. Alternatively a cement slug of a known volume can be injected into the string and is pumped through the tool 12. The volume of the slug is calculated to create a plug extending the length of the annulus between the cuts 46, 48 and the cuts 56,58. Typically the distance between the first and second cuts is at least 100 feet, and typically an excess of cement (e.g. 2-300%) is used in order to ensure that the annular cement plug is sufficiently long.

The anchoring devices are then deactivated and the string 10 is pulled up out of the borehole before the cement sets. Excess cement that has emerged from the upper cuts 56, 58 is wiped out of the bore by the seals on the tool 12. At this time, the tool can be redressed to remove the ball/dart from the circulating sub 14 so that fluid can circulate through the sub 14 once more.

Figure 5:
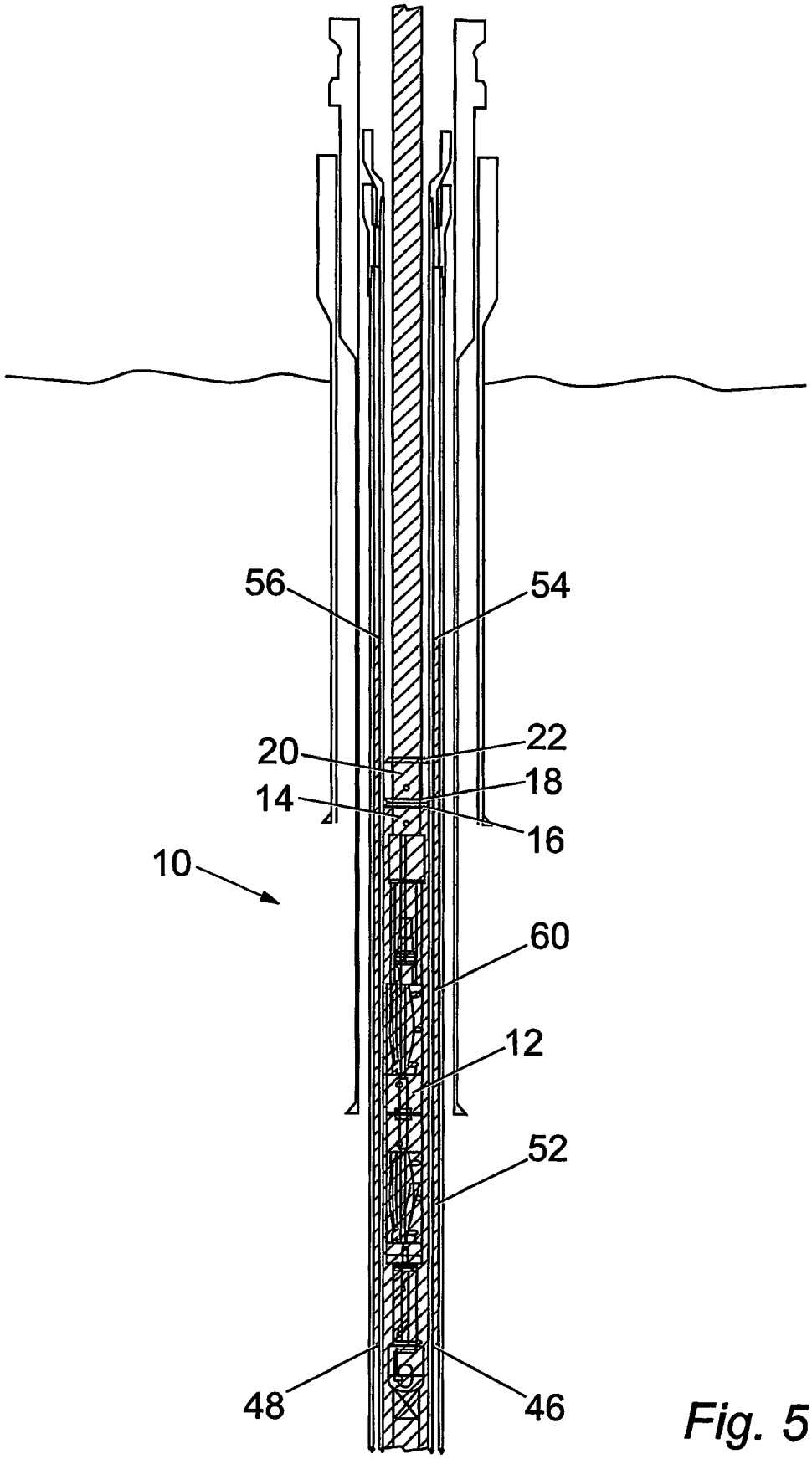
FIG. 5 shows a partial cross-section of the abandonment string performing a final pressure test on the cemented annulus.
Figure 6:
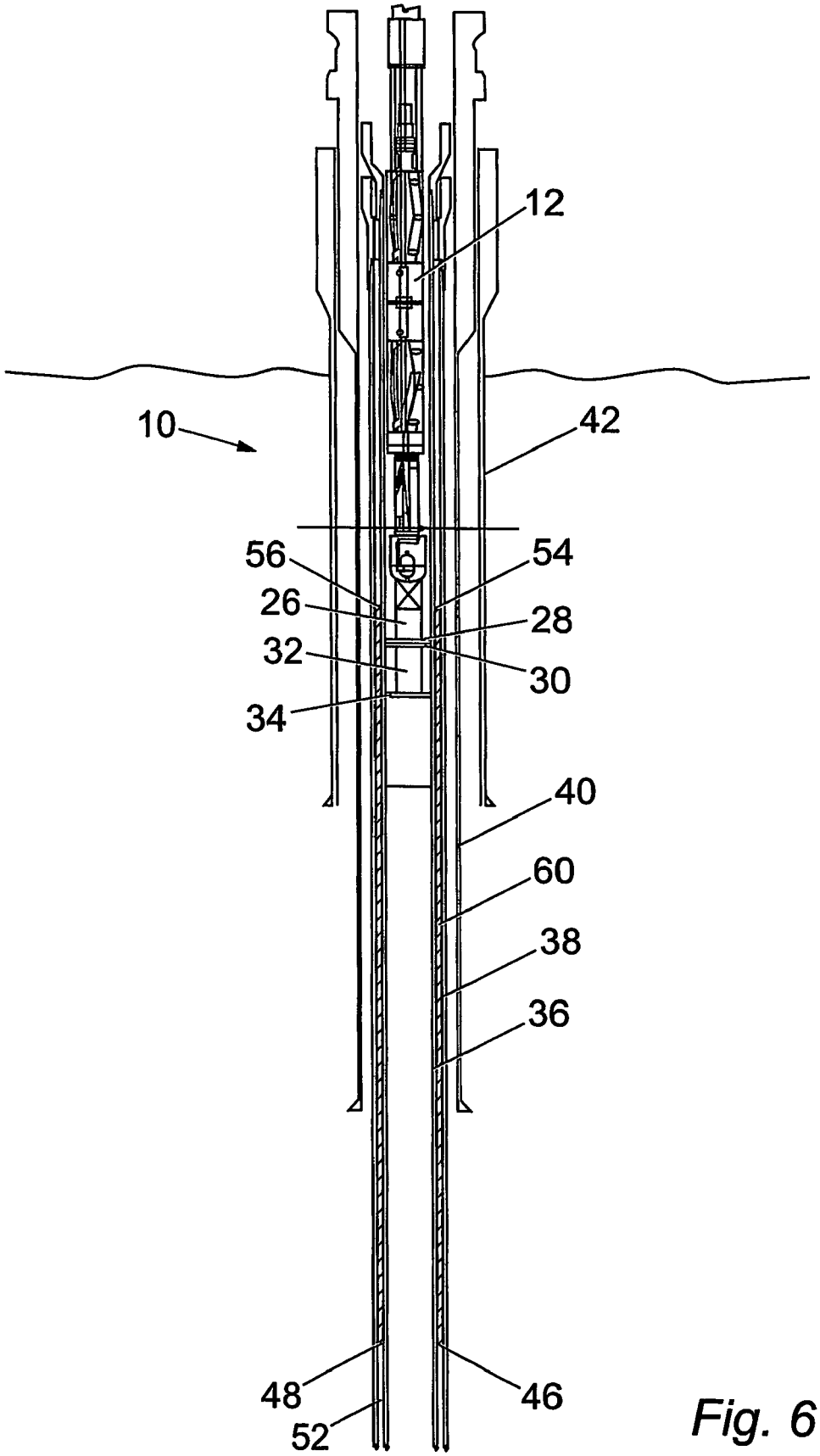
FIG. 6 shows a partial cross-section of the abandonment string cutting through all the casing strings at the wellhead.
Figure 12:
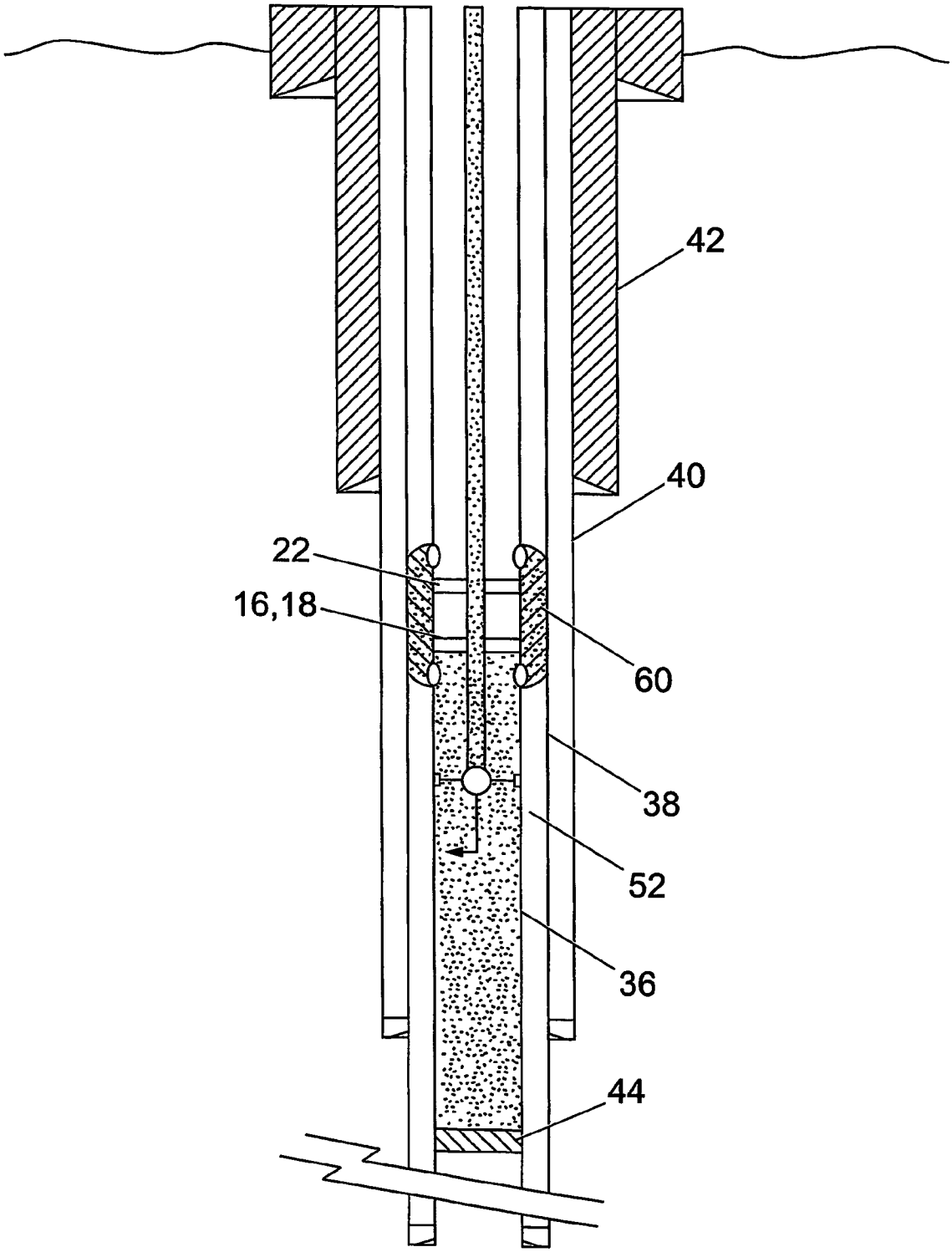
FIG. 12 shows a schematic cross-section of the cement in the annulus between the cuts being pressure tested.
Figure 13:
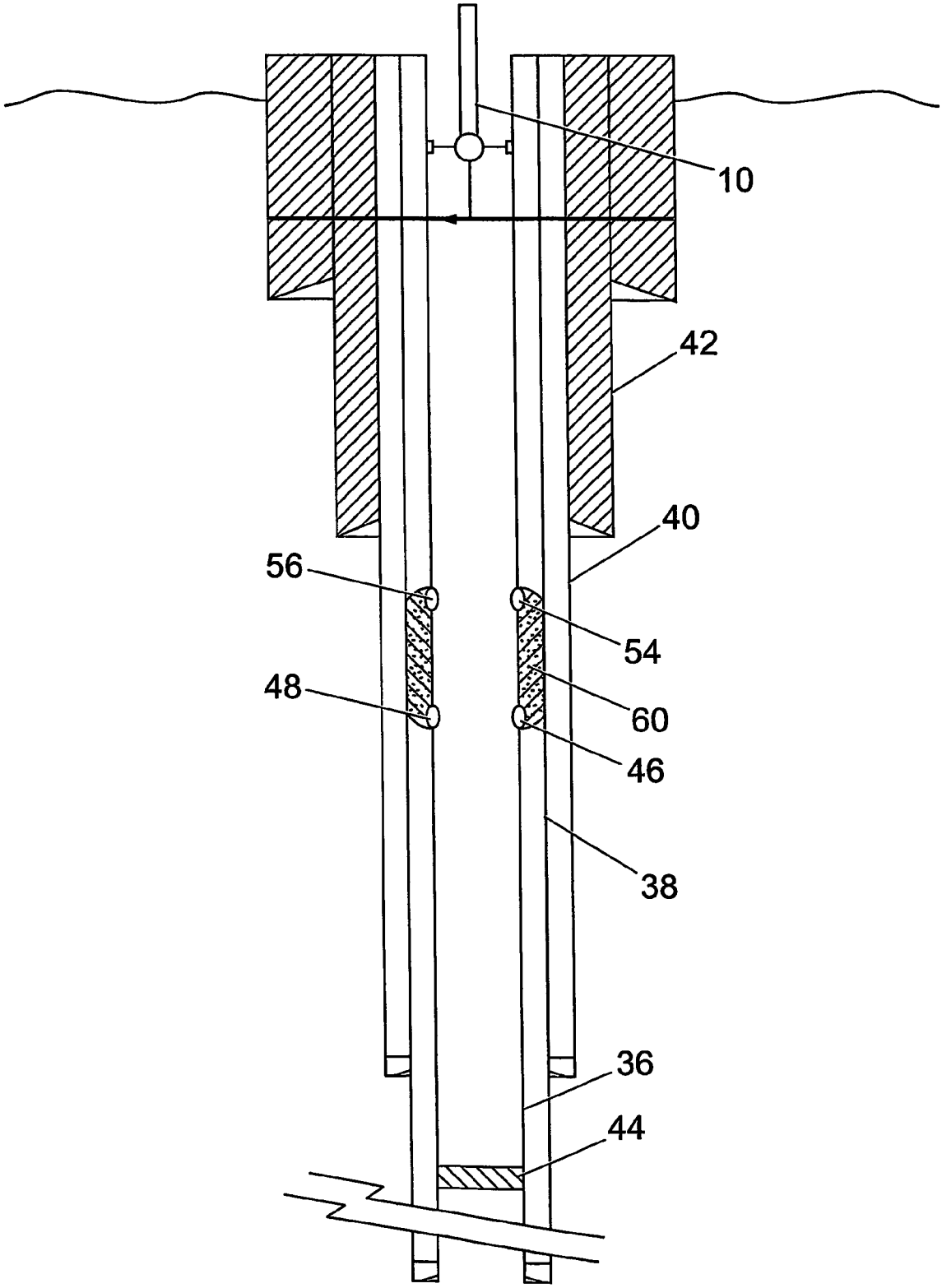
FIG. 13 shows a schematic cross-section of the casings being cut near the wellhead.

When the new cement is set, the string 10 is run into the borehole again so that the cup-type seal assemblies 16, 22 are in between cuts 46, 48 and cuts 54, 56, as shown in FIGS. 5 and 12. The annular plug of cement in the section 60 of annulus 52 between the cuts 46, 48 and cuts 54, 56 should now be solid. To test this, fluid (e.g. water) is then pumped down the string 12 and through the hole in the circulating sub 14. If no significant injection of fluid into the annulus 52 is possible, then this proves that the cement job has been successful and that the section 60 of annulus 52 is firmly sealed.

If this is the case, the tool 10 is unanchored, raised and re-anchored so that the cutter of the cutting tool 12 is near the wellhead. The cutting tool 12 is then used to cut through all the casings 36, 38, 40, 42 by continuous cutting while the head rotates around 360°.

In the case of the string 100, the procedure is the same but the port 20*a* between the cups 22,18 can optionally be used for cement injection, whereas the other port 20*b* can be used for pressure testing between the upper 22 and lower 18 seals prior to any perforations being made. Thus testing of the upper and the lower seals 22, 16 can optionally be done without moving the string.

Modifications and improvements may be incorporated without departing from the scope of the invention. For example, after the cement has been injected into the annulus, instead of withdrawing the string 10,100 back to surface, the string 10,100 can be pulled up just above the upper perforations 54,56, to wait on cement (if a cement slug has been used) or can be pulled up until the ports 20 are above the wellhead, where the cement can be purged from the drill-string, the port 20*a*, and the area between the seals 22,18. When the cement has been purged (if necessary) then the string 10,100 can be run back into the hole to test the integrity of the annular cement seal at 60, by pumping seawater through either of ports 20*a* and 20*b*. This therefore allows the whole operation to be completed in a single run. In a further modification of the method, further radially outward annuli can be sealed in exactly the same way, optionally on the same run in the hole, by cutting through the two innermost layers of casing and into the second annulus behind that already sealed. Typically the plug in the second annulus overlaps the first plug, in accordance with normal procedures, and this can be achieved by making the first cut for the second plug between the first and second cuts of the first, and then raising the string 10,100 to a level above the second (upper) cuts of the first plug, before making the second (upper) cuts for the second plug. Clearly the outer plug could be set at a lower level than the first plug.

The high pressure rating of the tool allows control of hydrocarbons behind the perforated casings, and also can be used to inject behind numerous radially outward casings outside the innermost casing, or to break down the formation at these points. This high-pressure capability is useful if bullheading is required. Cutting through radially outward casing strings can be detected by observing pressure drops in the slurry hose.

When moving the string 10,100 through the hole the plunger effect can be minimised by allowing free passage of fluid through the string 10,100. Also, swabbing can be minimised when pulling out by pumping fluid down the string 10,100.

Embodiments of the present invention have the advantage that no explosives are used, which makes it more environmentally friendly. This also eliminates the risk of shattering the well plugs using explosives. Also, by following the method described above, the casing can be perforated and pressure tested, cement injected into the annulus between casings to seal the annulus and the casings severed all on a single run operation. Furthermore, the cutting tool can also be used to cut the concrete pancake at the top of the wellhead, breaking it up and hence reducing the amount of weight to be lifted after the casings are severed. The equipment is usually run on a drillstring, and can be run on coil tubing, so the abandonment string can be run from a derrick vessel, or a floating/jack-up rig, without requiring more expensive and permanent platforms, or even diving support vessels.

The invention claimed is:

1. A method of treating a well, including the steps of:

inserting well treatment apparatus into a cased wellbore, the apparatus including a cutting tool, a sealing device and an anchor means;

perforating the innermost casing in two vertically spaced positions; and injecting cement into a portion of the annulus between the two innermost casing strings to seal the annulus;

whereby the method includes the step of using the anchor means to anchor the apparatus to the cased wellbore.

2. A method as claimed in claim 1, including the step of pressure-testing the innermost casing before the first perforation is made by injecting a fluid into the wellbore below the sealing device.

3. A method as claimed in claim 1, including the step of pressure testing the annulus before the second perforation is made by injecting a fluid into the wellbore below the sealing device and measuring the equilibrium rate of pumping as the fluid flows through the first perforation into the annulus.

4. A method as claimed in claim 1, including the step of pressure-testing the annulus after the second perforation has been made by injecting a fluid into the annulus to check that there are no blockages in the part of that annulus lying between the vertically spaced perforations.

5. A method as claimed in claim 1, wherein the sealing device includes two oppositely-orientated cup devices, and the cement is injected into the annulus from an aperture in the apparatus located between these two cup devices.

6. A method as claimed as claimed in claim 1, including the step of pressure testing the sealed annulus by positioning the apparatus so that the sealing device lies between the two vertically spaced perforations and by injecting fluid into the wellbore below the sealing device.

7. A method as claimed in claim 1, including the step of using the cutting tool to sever the casings above the perforations after the annulus has been sealed.

8. A method as claimed in claim 1, the method including the step of undertaking at least one pressure test by injecting fluids, whereby during the pressure test, the apparatus is anchored to the casing by the anchor means to counter the force on the apparatus by the injected fluids.

9. A method as claimed in claim 1, wherein the well treatment apparatus is mounted on a drillstring and is manoeuvred in the wellbore by raising and lowering the drillstring.

10. A method as claimed in claim 1, wherein the sealing device comprises at least one annular cup device.

11. A method of treating a well, including the steps of:

inserting well treatment apparatus into a cased wellbore, the apparatus including a cutting tool; a sealing device comprising at least one annular cup device; and an anchor means;

perforating the innermost casing in two vertically spaced positions; and injecting cement into a portion of the annulus between the two innermost casing strings to seal the annulus;

whereby the method includes the step of using the anchor means to anchor the apparatus to the cased wellbore.

* * * * *